US010714225B2

(12) United States Patent
Ylimaki

(10) Patent No.: US 10,714,225 B2
(45) Date of Patent: Jul. 14, 2020

(54) SCALABLE CONTINUOUS-WAVE ION LINAC PET RADIOISOTOPE SYSTEM

(71) Applicant: PN Labs, Inc., Moseley, VA (US)

(72) Inventor: Robert J. Ylimaki, Moseley, VA (US)

(73) Assignee: PN Labs, Inc., Moseley, VA (US)

( * ) Notice: Subject to any disclaimer, the term of this patent is extended or adjusted under 35 U.S.C. 154(b) by 51 days.

(21) Appl. No.: 16/287,047

(22) Filed: Feb. 27, 2019

(65) Prior Publication Data

US 2020/0029420 A1 Jan. 23, 2020

Related U.S. Application Data

(60) Provisional application No. 62/639,576, filed on Mar. 7, 2018.

(51) Int. Cl.
*G21G 1/10* (2006.01)
*H05H 9/04* (2006.01)
(Continued)

(52) U.S. Cl.
CPC ..... *G21G 1/10* (2013.01); *H05H 6/00* (2013.01); *H05H 9/041* (2013.01); *H05H 9/045* (2013.01);
(Continued)

(58) Field of Classification Search
CPC .... G21G 1/00; G21G 1/10; G21G 2001/0094; H01J 23/08; H01J 25/60; H01J 27/00;
(Continued)

(56) References Cited

U.S. PATENT DOCUMENTS 5,523,659 A 6/1996 Swenson
6,777,893 B1 * 8/2004 Swenson ..... H05H 7/22 315/505
6,917,044 B2 7/2005 Amini
7,098,615 B2 8/2006 Swenson et al.
(Continued)

FOREIGN PATENT DOCUMENTS

WO WO 2010/007174 A1 * 1/2010 ..... H05H 6/00
WO WO2010007174 A1 1/2010
(Continued)

OTHER PUBLICATIONS

Yuri, et al., Uniformization of the transverse beam profile by means of nonlinear focusing method, Physical Review Special Topics—Accelerators and Beams 10, 104001 (2007), abstract, p. 104001-6 and figure 5.*

(Continued)

*Primary Examiner* — Sharon M Davis
(74) *Attorney, Agent, or Firm* — Goodman Allen Donnelly PLLC; Matthew R. Osenga, Esq.

(57) ABSTRACT

A continuous wave ion linear accelerator PET radioisotope system is disclosed. The system includes a high brightness $H^-$ ion source, a continuous wave RF quadrupole structure, and continuous wave RF interdigital structures to accelerate the ion beam to about 14 MeV. A high energy beam transport system is also described that includes a photo-detachment beam splitter and a magnet lattice for forming the proton beam into a beam having a Waterbag beam profile. The system also includes one or more targets upon which the proton beam is incident. The targets are either a high power metallic target oriented at about 10 degrees or a low thermal conductivity target oriented at about 35 degrees. The invention includes a method of producing PET isotopes by use of the systems described.

19 Claims, 20 Drawing Sheets

(51) Int. Cl.

| | |
|---|---|
| ***H05H 6/00*** | (2006.01) |
| *H05H 7/04* | (2006.01) |
| *H05H 7/00* | (2006.01) |
| *H05H 7/08* | (2006.01) |

(52) U.S. Cl.
CPC ..... *H05H 7/00* (2013.01); *H05H 7/001* (2013.01); *H05H 7/04* (2013.01); *H05H 2007/007* (2013.01); *H05H 2007/043* (2013.01); *H05H 2007/082* (2013.01); *H05H 2277/116* (2013.01)

(58) Field of Classification Search
CPC .... H01J 37/05; H01J 37/28; H05H 9/00–048; G21K 5/00; G21K 5/04; G21K 5/08
USPC ..... 315/505
See application file for complete search history.

(56) References Cited

U.S. PATENT DOCUMENTS

| | | | | |
|---|---|---|---|---|
| 7,940,881 | B2 | 5/2011 | Jongen et al. | |
| 8,288,736 | B2 * | 10/2012 | Amelia | G21G 1/00 250/428 |
| 9,991,013 | B2 | 6/2018 | Parnaste et al. | |
| 10,051,721 | B2 | 8/2018 | Lombardi et al. | |
| 2003/0015666 | A1 * | 1/2003 | Morgan | G21G 1/10 250/398 |
| 2007/0297554 | A1 * | 12/2007 | Lavie | G21G 1/10 376/190 |
| 2008/0128641 | A1 | 6/2008 | Henley et al. | |
| 2010/0086095 | A1 | 4/2010 | Ogasawara et al. | |
| 2010/0294655 | A1 | 11/2010 | Hong et al. | |
| 2013/0083881 | A1 | 4/2013 | Nutt et al. | |
| 2016/0203948 | A1 | 7/2016 | Huynh et al. | |

FOREIGN PATENT DOCUMENTS

| | | | | |
|---|---|---|---|---|
| WO | WO 2016/139008 | A1 * | 9/2016 | G21G 1/10 |
| WO | WO2016139008 | A1 | 9/2016 | |

OTHER PUBLICATIONS

Sadeghi, et al., Accelerator production of the positron emitter zirconium-89, Annals of Nuclear Energy 41 (2012), p. 97 and 99.*
Shafer, Laser Diagnostic for High Current H-Beams, Los Alamos National Laboratory, May 3, 2003, pp. 1, 3, 7.*
Triumf Type DC Volume-Cusp H-Ion Source high brightness, (Feb. 14, 2006), p. 1.*
Kuo et al. On the development of a 15 mA direct current H-multicusp source, Sep. 15, 1995, Figure 4.*
Sugai et al., Development of Hybrid Type Carbon Stripper Foils With High Durability Against 1800K for RCS of J-PARC, 2006. Proceedings of HB2006, abstract.*
Liu et al. "Laser wire beam profile monitor in the spallation neutron cource superconducting linac," Nuclear Instruments and Methods in Physics Research A 612 (2010) 241-253.*
Queern et al. "Production of Zr-89 using sputtered yttrium coin targets," Nuclear Medicine and Biology 50 (2017) 11-16.*
Sugai et al. Development of Hybrid Type Carbon Stripper Foils With High Durability Against 1800K for RCS of J-PARC, Proceedings of HB2006, pp. 122-124.*
Overview of High Brightness H-ion Sources, Proceedings of LINAC2002, pp. 559-563.*
D-Pace TRIUMF Type DC Volume-Cusp H-ion Source, Nov. 24, 2016.*
T. Nayak and M.W. Brechbiel "Radioimmunoimaging with Longer-Lived Positron-Emitting Radionuclides: Potentials and Challenges," Bioconj. Chem., 20(5): 825-841, May 20, 2009.
"Cyclotron Produced Radionuclides: Emerging Positron Emitters for Medical Applications: 64Cu and 124I," IAEA Radioisotopes and Radiopharmaceuticals Report No. 1, Mar. 2016.
R. A. Baartman, "Intensity Limits in Compact H-Cyclotrons," Proc. 14th Intl. Conf. on Cyclotrons and their Applications, Cape Town, South Africa, 2013.
Y. Liu, et al., "Laser Wire Beam Profile Monitor in the Spallation Neutron Source (SNS) Superconducting Linac," Nucl. Inst. Meth. Phys. Res. A612, 241-153, 2010.

* cited by examiner

SCALABLE CONTINUOUS-WAVE ION LINAC PET RADIOISOTOPE SYSTEM

CROSS-REFERENCE TO RELATED APPLICATION

This application claims the benefit of U.S. Provisional Application No. 62/639,576, filed Mar. 7, 2018, the contents of which are incorporated by reference.

FIELD OF THE INVENTION

The present invention pertains generally to Positron Emission Tomography (PET), and more particularly to a unique, scalable, economical system for long half-life PET radioisotope production. This invention embodies a special form factor, or configuration per se of the system, which is modular, flexible, and upgradeable for rapid scalability, as well as a number of unique features to achieve extremely high-power acceptance in isotope production target stations.

BACKGROUND OF THE INVENTION

Longer lived PET radioisotopes are widely recognized to play a growingly significant role in radioimmunoimaging protocols. Such protocols are needed for patient selection and assessment of response to immunotherapies, which are poised to become the backbone of all cancer treatment regimens. Such radioimmunoimaging protocols, also called "immuno-PET," have eluded translation into clinical practice due to the mismatch in pharmacokinetics of routine PET isotopes such as fluorine-18 with immunotherapies, such as antibodies. Large-scale, economical, reliable production of the longer-lived PET radioisotopes zirconium-89, iodine-124, and copper-64 is a long-standing problem. For many years, various researchers at different laboratories have employed compact cyclotrons using solid phase targets in the quest to supply clinically significant quantities of these isotopes. Such small-scale production is not economically attractive. The high costs of these methods are reflected in the scarcity and high prices. These are widely recognized barriers for clinical translation of immuno-PET into the standard of care.

Centralized, economical, large-scale production is cited as a critical need by the National Cancer Institute in a review article by T. Nayak and M. W. Brechbiel ("Radioimmunoimaging with Longer-Lived Positron-Emitting Radionuclides: Potentials and Challenges," Bioconj. Chem., 20(5): 825-841, May 20, 2009). In an authoritative review publication by sixteen radioisotope production experts for the International Atomic Energy Agency (IAEA), the reason given for the limited support for such large-scale production by the radiopharmaceutical industry is its being viewed as technically not achievable ("Cyclotron Produced Radionuclides: Emerging Positron Emitters for Medical Applications: 64Cu and 124I," IAEA Radioisotopes and Radiopharmaceuticals Report No. 1, March 2016). The IAEA report's authors call for the development of high-current, high-power acceptance targets. By accelerator physics convention, the term high-current refers to multi-milliampere beam current (A. W. Chao, et al. "Handbook of Accelerator Physics and Engineering," World Scientific, 2013). This convention applies to all references herein.

Commercial cyclotrons presently available for production of longer-lived isotopes push the limits of current, up to ~1 mA, according to A. W. Chao, et al. ("Handbook of Accelerator Physics and Engineering," World Scientific, 2013).

The azimuthally varying field (AVF) cyclotron, with magnetic field on hills and valleys—the industrial "deep valley" design—is the present state-of-the-art for PET and single-photon emission computed tomography (SPECT) isotope production. The deep valley field provides the necessary strong focusing and small beam size.

The resonant family of particle accelerators is comprised of cyclotrons, linacs, and synchrotrons. As multi-pass accelerators, cyclotrons achieve their final energy by circulating the charged particle beam in isochronous orbits several hundred times through an accelerating gradient generated by a single radio-frequency (RF) cavity in resonance. Operationally, RF amplifier power faults are one of the most common failure modes for resonant accelerators. Having just one RF cavity for acceleration, cyclotrons cannot be made fault-tolerant.

Cyclotrons are limited to simultaneous irradiation of dual targets, a significant restriction on scalability. Cyclotron target power acceptance has a ceiling of ~2 kW. Beam windows, typically titanium or gridded aluminum, deliver a multiply-scattered, Gaussian beam profile to the dual targets. The use of non-linear focusing, i.e., octupole magnetic fields, to "flat-top" the Gaussian beam is an intractable problem, as existing cyclotron facilities have been built in such a manner as to preclude proper placement of the octupoles. Irradiation of solid phase targets is performed by "rastering" the Gaussian beam-sweeping the beam back-and-forth and up-and-down the face of the target plate using active beamline elements (magnets). This limits the time the peak power density is incident of any portion of the target substrate material to minimize the potential for damage due to melting.

High-brightness H− ion source development solved many of the thermal, mechanical, and radio-activation problems associated with cyclotron dual beam extraction. Most compact cyclotron designs use an internal ion source, suited only for low to moderate beam currents-150 to 300 μA. Internal ion sources place many constraints on the design of a new cyclotron central region, making beam matching, bunching, and manipulation impossible. An internal ion source places a gas leak directly into the cyclotron, which is bad for negative ions such as H− and raises vacuum requirements.

An external ion source is required for multi-milliampere beam currents. These are incorporated into the higher-energy cyclotrons used for production of longer-lived isotopes referenced by A. W. Chao. External ion sources are used in the industry's flagship cyclotrons, e.g., the Advanced Cyclotron Systems, Inc. (ACSI) TR-30, making 90% of the thallium-201, iodine-123, gallium-67, and indium-111 supplied in North America, with its 1.2 mA rating, and the Ion Beam Applications (IBA), S. A., Cyclone 30 VHC cyclotron, also rated at 1.2 mA.

Recent data support the inference that cyclotrons are not a viable technology platform for true high-current targets as they have reached their technology limit at 3 mA. Study data compiled by R. A. Baartman of $H^-$ cyclotron design at TRIUMF using the ACSI TR30/CRM model determined that fundamental limits on beam current exist due to space charge effects, both transverse and longitudinal ("Intensity Limits in Compact $H^-$ Cyclotrons," Proc. 14th Intl. Conf. on Cyclotrons and their Applications, Cape Town, South Africa, 2013). Space charge reduces vertical focusing, placing an upper limit on instantaneous current. Longitudinal space charge reduces acceptance as well as average current per the author. These limits cannot be economically overcome. The author's data and derived relation predict an upper limit on beam current extracted ($I_{extr}$) from the TR30 cyclotron of 3.3 mA for an injected current ($I_{inj}$) of 30 mA:

$$I_{extr} = \frac{I_{inj}}{5}\left[\frac{(60\text{ mA} - I_{inj})}{54\text{ mA}}\right]$$

The current record of 3 mA is held by the TR30/CRM at TRIUMF. Due to the unavoidable losses of 20% of extractable beam current on each of the cyclotron's two target beamline collimators, multi-millampere target currents are not obtainable. The engineering solution is an uneconomical dramatic increase (>44%) in cyclotron size, driving a further need for more heavy concrete for the machine vault, and a corresponding increase in decommissioning costs. Even with external ion sources, cyclotron technology has fundamental limits on beam current due to space charge, which have hampered the development of high-current targets for large-scale iodine-124, copper-64, and zirconium-89 production.

The capability to accelerate H− ions at higher intensities, at low emittance, than is presently available will contribute to isotope production. For high beam currents in the range of 10-200 mA, a radio frequency quadrupole (RFQ) is one of the required accelerating structures. Linear accelerators (linacs), employing RFQs in their design, represent one of the main technologies for the acceleration of charged particles (atomic ions) from a source (ion source) to the desired final energy. A 14 MeV proton beam is optimal for production of zirconium-89, copper-64, and iodine-124 via their respective high-purity, proton-neutron exchange nuclear reactions:

$^{89}Y(p,n)^{89}Zr$, $^{64}Ni(p,n)^{64}Cu$, and $^{124}Te(p,n)^{124}I$.

The needs of the first two target materials are quite different from the third: yttrium-89 and nickel-64 are representative metallic target substrates, while the tellurium-124 enriched TeO2 is a low thermal conductivity oxide. Tellurium-124 enriched oxide is preferred over metallic tellurium-124 for iodine-124 manufacture. The former requires only thermochromatographic separation ("dry distillation") of the iodide oxidation species, while the latter involves arduous wet chemical processing. Both metallic and low thermal conductivity target variants benefit from a constant proton fluence rate on the target plate. It is essential for the latter target variant to avoid thermal shocks and consequent losses of expensive enriched material (e.g., tellurium-124) during irradiations at high power acceptance. Thus, two high power target station variants are warranted for longer-lived PET isotope production, and a constant proton fluence rate is highly advantageous for low production costs.

A high-duty-factor linac is necessary to avoid the high peak currents associated with the Alvarez drift-tube linac (DTL). For a high-duty-factor-here 100%, or continuous-wave (CW)—linac, the cooling of the RFQs and downstream accelerating structures' copper cavities becomes an important engineering constraint. This reflects one of the disadvantages of normal conducting (or room temperature) copper-cavity linacs: the large radio frequency (RF) power required due to ohmic dissipation in the cavity walls. As a result, both RF power amplification and AC power for operations are major costs for a copper cavity CW ion linac.

New linac designs are evaluated for application of superconducting RF cavities for their advantages over normal conducting copper cavities. The use of superconducting niobium cavities allows for a reduction in RF surface resistance on the order of $10^5$ when compared with room temperature copper. Therefore, application of superconducting RF cavities (SCRF) as linac accelerating structures is recognized as offering better performance and lower AC power and RF power costs. Some of this gain in reduced surface resistance is offset by the inefficiency of cryogenic refrigeration for liquid helium at 4 K or below with superconducting RF cavities of niobium. Another disadvantage is the significantly increased cost and complexity of a superconducting linac, with less advantage in lower RF power costs for low-β (0.1-0.2 in units of the velocity of light) applications.

U.S. Pat. No. 6,777,893, entitled "Radio Frequency Focused Interdigital Linear Accelerator," to Swenson, introduced an RF focused interdigital linac, or "RFI" accelerating structure as the basis for a normal conducting copper cavity linac. This structure incorporates RF focusing into the drift tubes of an interdigital linac structure which is more compact and energy efficient. It has been used, also by Swenson, to extend the performance of a proton RFQ linac structure to 2.5 MeV for the Boron Neutron Capture Therapy (BNCT) application. For the application of longer lived PET radioisotope production, it is useful to extend the performance of the RFQ to 14 MeV. The RFI linac is ten times more efficient than the RFQ in the 6-14 MeV energy range. Furthermore, it is desirable to scale the RF power amplification in modular fashion. Since the linac is a single-pass accelerator, fault-tolerance for reliability in operations may be engineered into a PET radioisotope system based on the CW ion linac.

Economical scalability requires the simultaneous delivery of high current proton beams to multiple high-power acceptance isotope production targets from a single particle accelerator. However, splitting a high current proton beam between multiple targets to deliver a constant proton fluence rate on the target plate while preserving parent beam parameters is an intractable problem. This requires negative ions for extraction of target current by charge-exchange reactions. Thus, a high-brightness H− ion source must undergo matching of the injected beam ellipse to the focusing system of the RFQ. The RFI linac structure of Swenson can accommodate acceleration and focusing of negative ions by shifting the phase of all fields by one half cycle. The subsequent beam splitting operation should preserve the parameters of the parent beam, including size, divergence, energy, energy spread, and phase spread. Y. Liu ("Laser Wire Beam Profile Monitor in the Spallation Neutron Source (SNS) Superconducting Linac," Nucl. Inst. Meth. Phys. Res. A612, 241-153, 2010) describes a laser-photo-detachment ("laser-wire") method that has been put in practice at the Oak Ridge National Laboratory's Spallation Neutron Source (SNS) for beam diagnostics applications on the 1 GeV superconducting H− linac to parasitically monitor beam parameters. In units of the velocity of light, the SNS H− linac has β=0.875. A CW ion linac for long-lived PET radioisotope production of iodine-124 and zirconium-89 has β=0.1734 for 14 MeV protons.

Following this, beam manipulation by a non-linear focusing magnet in a lattice arrangement could reduce the peak power density for achieving higher power acceptances. This would result in "flat-topping" the Gaussian beam profile to deliver a constant proton fluence rate on the target plate. This delivers the so-called Waterbag beam profile. Beam uniformization to the Waterbag profile substantially reduces the peak power density, allowing much higher beam currents and higher power acceptance without risk of target damage by approaching any of the melting points of the target plate or deposited substrate undergoing irradiation, the latter often comprised of expensive enriched stable isotopes.

As a beam window between the incident proton beam and target plate results in a multiply-scattered, Gaussian beam profile, high-power acceptance targets must be present in a "windowless" configuration to use the Waterbag beam distribution. This configuration eliminates the typical grid-supported aluminum foil which provides both a vacuum boundary and a seal for chilled helium gas cooling on the face of the target plate common to solid phase cyclotron targets.

For high-power acceptance, target cooling systems must handle high incident heat fluxes, exceeding 1 $kW/cm^2$, to achieve large-scale production capacity. This heat flux represents the practical limit of water cooling technology. The use of high-velocity water jets for cooling targets at 1 $kW/cm^2$ is suited only for small targets. For the large metallic targets of the present invention, conditions will exceed the critical heat flux (CHF) limit for water cooling (500 $W/cm^2$). Beyond this limit, heat flow is unstable, vapor blankets the heated surface of the back of the target plate, and temperatures jump to very large values. This heat flow regime is governed by film boiling and radiative transfer, called burnout.

The replacement of water as the coolant working fluid with a eutectic Ga—Sn alloy offers substantial heat transfer benefits with few drawbacks. Eutectic Ga—Sn alloy offers fifty times better thermal conductivity than water with linear heat removal all the way up to its boiling point of 1200° C. However, gallium is compatible with target materials such as stainless-steel, titanium, and elastomers, but corrodes aluminum. The target plate irradiation capsule, or "rabbit," must be an aluminum exclusion zone. Above 300° C., desirable metals are limited to cobalt, chromium, titanium, tantalum, niobium, molybdenum, rhenium, and tungsten. With appropriate materials selection, the high-power acceptance target provides sufficient cooling margin to protect against reaching any target material melting points. Together, beam uniformization and cooling capacity margin of safety prevent unacceptable losses of the aforementioned enriched target materials.

SUMMARY OF THE INVENTION

The invention relates to various exemplary embodiments, including systems and apparatus for Positron Emission Tomography (PET) radioisotope production. These and other features and advantages of the invention are described below with reference to the accompanying drawings.

BRIEF DESCRIPTION OF THE DRAWINGS

In FIG. 2, the two-dimensional nature of the beam axis in the HEBT 36 portion of the system of the invention is made apparent at the position of each laser-wire beam splitter component.

DETAILED DESCRIPTION

Figure 1:
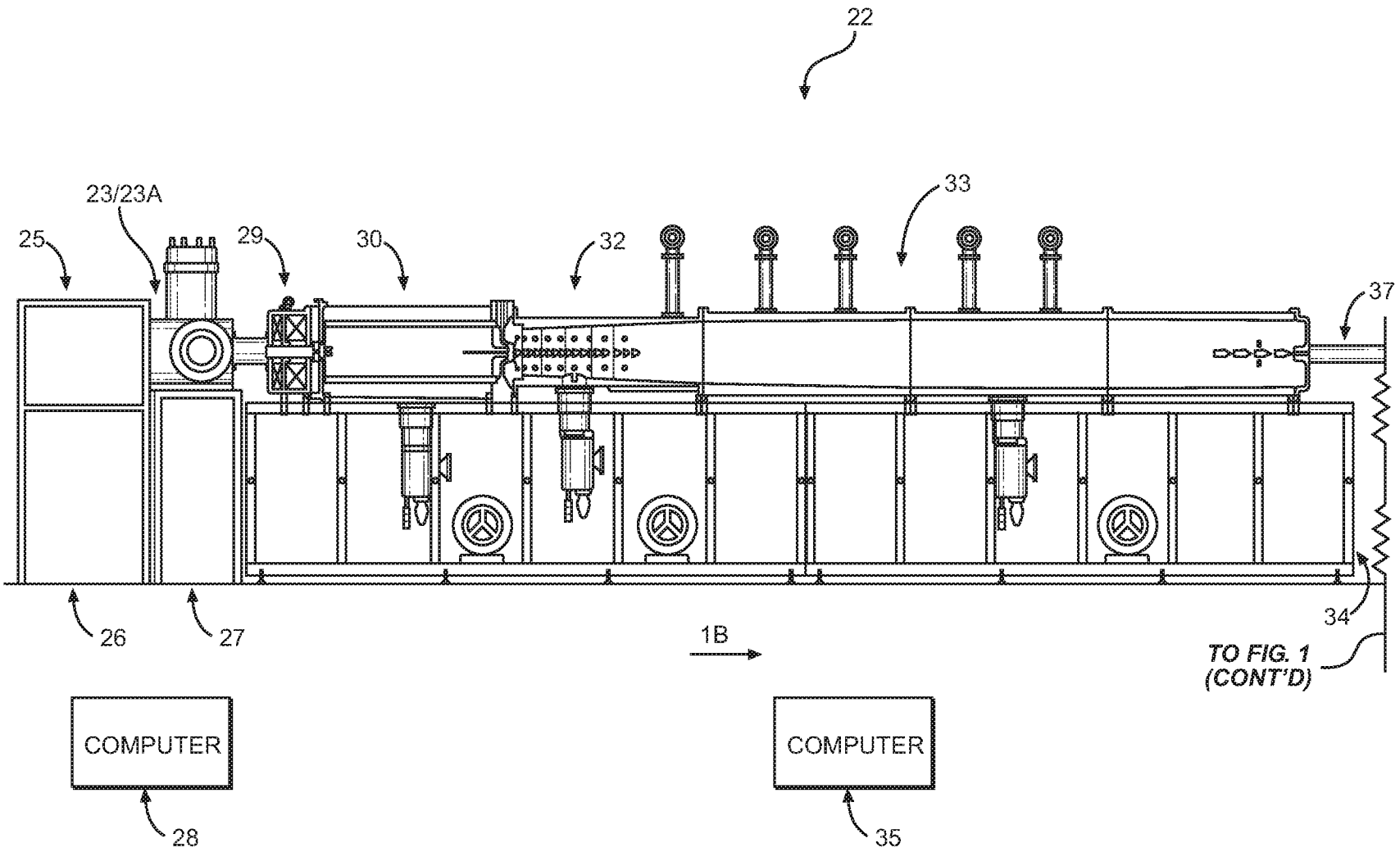
FIG. 1 is a simplified schematic illustration (a side elevation) of the Continuous-Wave (CW) PET radioisotope production structure (system) of the present invention. In this figure, the components which make up this system are illustrated lying substantially along, and in alignment with, a horizontal line which defines the operational axis (the beam axis) of the system 1B.
Figure 1:
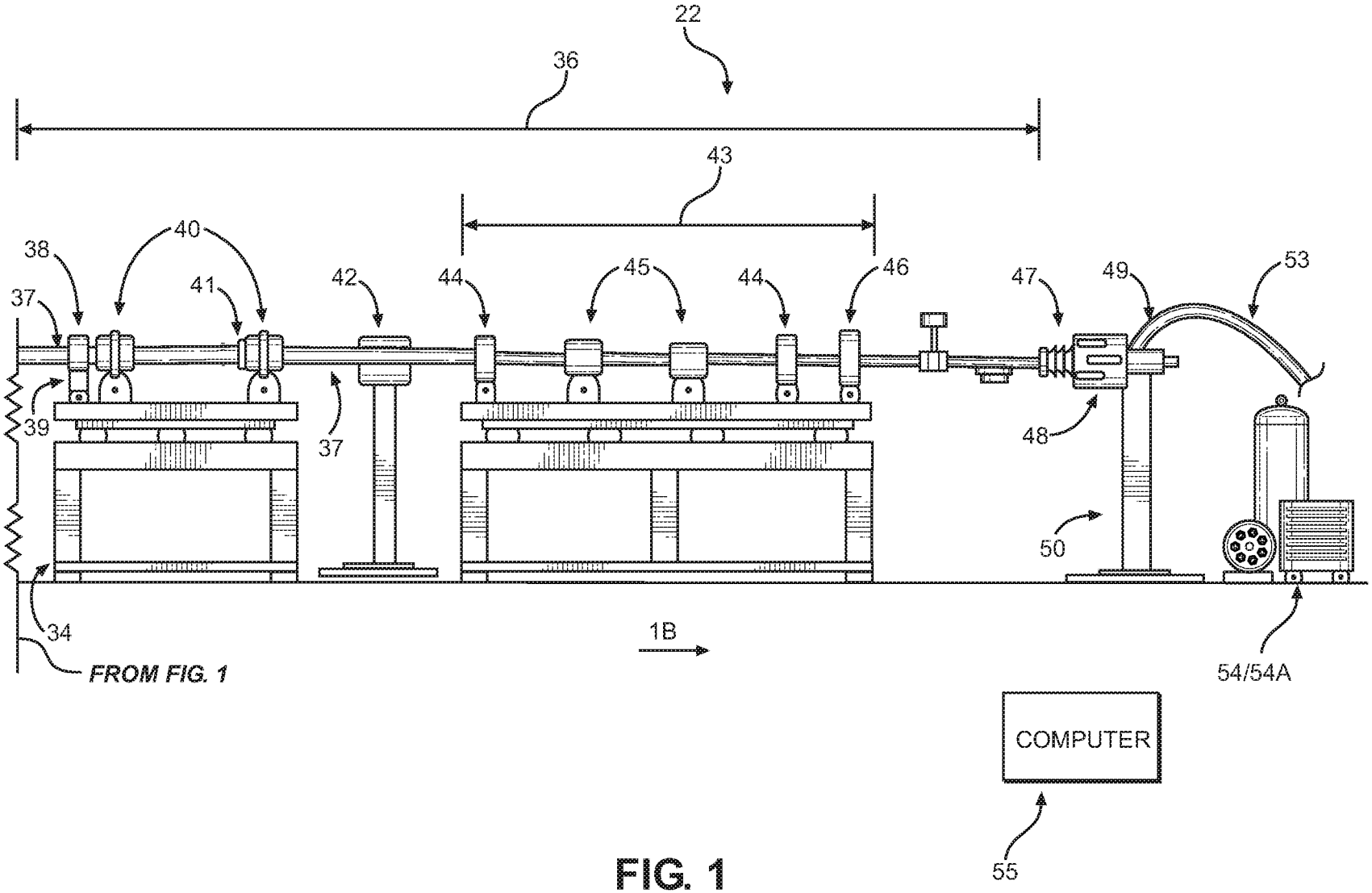

The following description is merely exemplary in nature and is not intended to limit the present disclosure, application, or uses. It should be understood that throughout the drawings, corresponding reference numerals indicate like or corresponding parts and features.

Before the present invention is described in further detail, it is to be understood that the invention is not limited to the particular embodiments described, and as such may, of course, vary. It is also to be understood that the terminology used herein is for the purpose of describing particular embodiments only, and is not intended to be limiting, since the scope of the present invention will be limited only by the appended claims.

A number of materials are identified as suitable for various aspects of the invention. These materials are to be treated as exemplary and are not intended to limit the scope of the claims. Although any methods and materials similar or equivalent to those described herein can also be used in the practice or testing of the present invention, a limited number of the exemplary methods and materials are described herein.

It must be noted that as used herein and in the appended claims, the singular forms "a," "an," and "the" include plural referents unless the context clearly dictates otherwise.

In general, the meaning of the various terms and abbreviations as used herein is as they are generally used and accepted in the art, unless otherwise specified. In order to aid in the understanding of the invention, specific meanings of several terms are provided.

As used herein, "large scale production" when applied to longer lived PET isotopes zirconium-89, iodine-124, and copper-64 means the provision of sufficient radioactivity to meet the demand of one million or more patient doses per annum.

The term "high current" as applied to beam current means a beam current of two milliamperes or greater. Similarly, the term "multi-milliampere" refers to currents of at least about two milliamperes. High power acceptance when applied to target stations requires managing the heat fluxes associated with high beam currents. The term "high power" is used to refer to power acceptance ranging from ten to many tens of kilowatts (kW).

Brightness applied to ion source output is a figure of merit defined as the number given by output beam current divided by the square of the beam emittance. Emittance means the two dimensional area in ion beam phase space that is enclosed by an equal intensity contour line enclosing 90% of the total beam current, $\beta\gamma$ normalized. The term "high brightness" as applied to ion source output means a brightness figure of three or greater.

As used herein, the term "low emittance" refers to a normalized total emittance of about 1.0 $\pi$ mm-mrad.

A "continuous-wave (CW) linac" refers to the continuous in time beam current pulse repetition rate for a 100% beam duty factor.

A beam having a "Waterbag beam profile" refers to a beam having a two-dimensional transverse beam profile with an rms uniformity of 5% or better.

Several types of beam transports are described and used herein. A "low-energy beam transport (LEBT)" permits high acceptance (95%) of the injected $H^-$ beam at an ion energy of a few tens of keV. A "medium-energy beam transport (MEBT)" refers to beam having an ion energy of about 1 MeV. A modular "high-energy beam transport (HEBT)" refers to a transport at the final ion energy of about 14 MeV.

The term "low thermal conductivity" refers to a thermal conductivity of less than about 3 $W\text{-}m^{-1}\text{-}K^{-1}$.

In general terms, the invention is a continuous wave ion linear accelerator PET radioisotope system that includes a high brightness $H^-$ ion source that produces a multi-milliampere beam of $H^-$ ions. A continuous wave radio frequency quadrupole structure accelerates the $H^-$ ion beam to about 1 MeV. One or more continuous wave radio frequency interdigital structures further accelerate the beam to about 14 MeV. A high energy beam transport system transforms the accelerated beam to a uniform transverse profile proton beam. The uniform proton beam is incident on one or more high power target stations that include a target capsule where the PET radioisotopes are produced. The radioisotopes are recovered in a target capsule transfer system. The invention also includes a method of producing PET radioisotopes.

The high energy beam transport system includes one or more photo-detachment beam splitters that transform at least a portion of the accelerated $H^-$ ion beam into a Gaussian profile proton beam. One or more non-linear focusing magnet lattices defocus the Gaussian profile proton beam.

The high power target station is windowless with axially symmetric cooling inlet and outlet connections. The cooling system working fluid is typically water or eutectic gallium tin alloy. The target station includes a face having a substrate upon which the proton beam is incident. When the target station includes a metallic target plate, the plate is oriented at a glancing angle of about 10 degrees relative to the proton beam. In several exemplary embodiments, when the target plate is copper, the substrate is yttrium; when the target plate is silver, the substrate is nickel.

As an alternative to the metallic target plate, the plate can be a low thermal conductivity plate, which would then be oriented at a glancing angle of about 35 degrees relative to the proton beam. In an exemplary embodiment, when the target plate is iridium, the substrate is tellurium oxide or copper selenide.

Examples of PET radioisotopes that can be produced by the system and method of the present invention include the following: Zirconium 89 ($^{89}Zr$) when the target substrate is yttrium 89 ($^{89}Y$); Iodine 124 ($^{124}I$) when the target substrate is tellurium 124 enriched oxide ($^{124}TeO_2$); Bromine 76 ($^{76}Br$) when the target substrate is selenium 76 enriched copper selenide ($Cu_2{}^{76}Se$); and Copper 64 ($^{64}Cu$) when the target substrate is nickel 64 ($^{64}Ni$).

The present invention is a continuous-wave, fault-tolerant RF negative ion linac deployed in a scalable configuration with laser-photo-detachment beam splitter and non-linear focusing magnet arrangement with field strengths to provide for beam uniformization to the Waterbag beam profile. In this context, and as will be seen, in addition to utilitarian uniqueness which is expressed in this invention through the capability for economically advantageous scalability for large-scale production of PET radioisotopes previously envisioned as technically not achievable, by its high-energy CW ion linac and particle-beam-transport components which make up portions of the system of the invention, this special "nature" leads to a uniquely flexible, high-reliability configuration simultaneously accommodating multiple high-power acceptance target stations.

These characteristics provide the system with the ability to be: (a) rapidly and economically scalable for centralized supply of longer-lived PET radioisotopes for widespread availability to support translation of radio-immunoimaging protocols ("immuno-PET") into the clinical standard of care; (b) highly reliable in CW ion linac operations due to modularity of design in RF power amplification which grants fault-tolerance, and allows faulty modules to be "hot-swappable," further minimizing down-time; (c) capable of delivering high beam currents simultaneously to multiple target stations; (d) capable of uniformization of Gaussian beam to a Waterbag beam profile to maximize power acceptance; (e) capable of withstanding extreme thermal stress on target plates during irradiation; (f) able to minimize personnel exposure by highly reliable transfer of irradiated target plates to hot cells for radiochemical processing; and (g) adopted to the limitations of master/slave remote manipulators for isotope recovery in hot cells to meet As Low as Reasonably Achievable (ALARA) exposure guidelines for handling of radioactive materials. Some or all of these may be achieved through implementation of the present invention.

The radioisotope production components of the proposed system are arranged initially in a straight-linear fashion, progressing through the system from the low-energy end to the high-energy end. The components of the system of the invention include: (a) a DC volume-cusp ion injector source capable of high-brightness H− ion beams; (b) a low-energy beam transport (LEBT) permitting high acceptance (95%) of the injected H− beam; (c) a radio frequency quadrupole (RFQ) structure; (d) an RF coupler for medium-energy beam transport (MEBT); (e) a series of radio frequency interdigital (RFI) linac structures; (f) in an arc fashion, a modular high-energy beam transport (HEBT) incorporating a laser-photo-detachment ("laser-wire") beam splitter and non-linear focusing magnet lattice; (g) a high-power acceptance, sandwich-type metallic target station; (h) a high-power acceptance, low thermal conductivity (e.g., oxides) target station; and (i) target capsule transfer components, terminating in the radioisotope processing hot cell with target capsule opening/closing device adapted for master/slave remote manipulation of the irradiated target plate.

To aid in appreciating certain technical background information, the contents of U.S. Pat. No. 6,777,893, which may be helpful in understanding the nature of the present invention, is hereby incorporated by reference into this disclosure.

The present invention utilizes an RFQ linac structure for high-current (10-200 mA) operations. RFQ structures have small ion beam diameters, and because the transverse focusing of the RFI linac structure is electric, similar to that of the RFQ structure, the RFI will have the same small diameter ion beam. Consequently, matching the ion beam from an RFQ into the RFI linac is straightforward. The RFI linac structure offers improved capabilities to capture and accelerate low-energy ion beams. With its improved beam quality and higher RF power efficiency for high-duty-cycle operations, such as continuous-wave (CW), the RFI linac can accelerate much higher currents than achievable with cyclotron technology.

The CW ion linac PET radioisotope system of the present invention provides acceleration to ion energies in the range of 10 MeV to 15 MeV of high-intensity CW negative ion beams, with beam currents on the order of 10 mA readily obtainable. By melding electric focusing-long recognized as the best method for focusing low-energy ion and proton beams—and acceleration of a high-current, CW, negative ion beam, this leads to an important advance in longer-lived PET radioisotope production. This performance advance enables the system of the present invention to provide the multi-milliampere proton beam currents for the irradiation of high-power acceptance targets that are essential for clinical translation of medical applications using longer-lived PET isotopes, such as immuno-PET with zirconium-89 and iodine-124.

The CW ion linac PET radioisotope system of the present invention combines a high-brightness negative ion ($H^-$) ion source with the strong RF focusing of the RFQ linac and the efficient acceleration of the RFI linac to provide compact, commercially-viable, linear acceleration of a multi-milliampere CW H− beam at a relatively low cost.

The CW ion linac PET radioisotope system of the present invention includes modularity in the design of the CW ion linac and high-energy beam transport system (HEBT) for a highly reliable platform technology for medical isotope production. This design provides longer-lived PET radioisotopes requiring protons in the 0.1 to 0.2 times the velocity of light. With radioactive half-lives between 16 hours and 4.18 days, these longer-lived isotopes and their radiopharmaceuticals are suited to centralized production and distribution. The CW ion linac radioisotope system provides for high reliability in its operations by its modular, fault-tolerant RF power architecture, and its axially-symmetric target capsule, which eliminates the frequent failures associated with axial positioning systems in target capsule transfer.

The CW ion linac PET radioisotope system of the present invention may provide for the simultaneous irradiation of up to six high-power acceptance targets. This feature enables the scalability required for centralized supply of late-stage clinical trials involving large patient cohorts, as well as post-approval unit dose manufacturing for millions of PET scans annually. The modular HEBT system incorporates laser-photo-detachment beam splitters which preserve the parent $H^-$ beam parameters, and dipole bending magnets to separate the parent $H^-$ and proton beams for transport to the subsequent optical interaction cavity for the former, and a non-linear focusing magnet system for the latter.

The CW ion linac PET radioisotope system of the present invention may provide for the uniformization of the proton fluence rate incident on the target plate by incorporation of a non-linear magnet focusing system. The multiply-scattered, Gaussian beam profile undergoes "flat-topping" to the uniform Waterbag beam distribution for effective management of peak heat fluxes by the high-power acceptance target stations.

The CW ion linac PET radioisotope system of the present invention may also provide the high-power target station with the capability to manage extremely high heat fluxes (exceeding 1 kw/cm$^2$). The use of eutectic Ga—Sn alloy as the cooling system working fluid for the high-power metallic target plate results in linear heat removal all the way up to its boiling point of 1200° C., permitting multi-milliampere target currents and power acceptance in excess of 50 kW. This is achieved while operating far from the melting points of the target metals.

The CW ion linac PET radioisotope system of the present invention may provide high-power acceptance for the low thermal conductivity target station, with no beam window ("windowless") to result in a multiply-scattered, Gaussian, beam profile requiring "rastering" of the beam by x-y steering magnets. Rather, high-power acceptance in excess of 10 kW is achieved through the non-linear focusing magnet system's flat-topped ("Waterbag") beam profile which mitigates peak heat fluxes for the low thermal conductivity (3 W-m$^{-1}$-K$^{-1}$) tellurium-124 enriched tellurium oxide. Tellurium oxide also possesses a relatively low melting point at 733° C., and the crystalline form used is brittle, cracking easily due to thermal stresses. Tellurium oxide is preferentially used for iodine-124 production due to the simplicity of thermo-chromatographic recovery.

The CW ion linac PET radioisotope system of the present invention may also provide axially-symmetric target capsules common to both the high-power metallic target and low thermal conductivity target. Axial symmetry (about beam axis 1B) of the coolant inlet and outlet channels obviates the need for an axial positioning system for such inlet and outlet. These axial positioning systems provide a frequent mode of failure in target capsule transfer systems.

The CW ion linac PET radioisotope system of the present invention includes targets that may be shielded in all directions. As is well known to those generally skilled in this art, it is important that an overall device like that which is disclosed herein be adequately shielded to prevent exposure to radiation with respect to people who work near and around such a system. In one implementation of the present invention, only the incoming beam pipe is a source of neutron leakage, so there is a substantial reduction in decommissioning costs and environmental impacts due to radioactivation of concrete and other nearby structural materials.

The CW ion linac PET radioisotope system is rapidly scalable, comprised of CW $H^-$ linac, high-energy beam transport (HEBT)—laser photo-detachment (aka "laser wire") beam splitter, non-linear focusing magnets—for up to six targets. For incident heat flux of up to 1 kW/cm$^2$ on the target plate, we use eutectic Ga—Sn alloy cooling with Ar gas overpressure (to prevent Ga oxidation). The extreme-power metallic target incorporates a unique high-power eight-sector collimator and elongated octagonal target plate into a titanium capsule ("rabbit") for transfer to the target processing hot cell by pneumatic transfer system. The axially-symmetric rabbit needs no axial positioning, the most common failure mode of such systems. The target's large surface area, low critical angle, explosion welded yttrium cladding, and finned back offer the optimum combination for eutectic Ga—Sn alloy coolant. It is believed that this is the first system to successfully use the Waterbag beam profile-since our HEBT uses octupole/dodecapole magnets for "flat-topping" the Gaussian beam.

As will be seen from the description of the invention set forth below, the system of the present invention directly and effectively addresses various performance, scalability, economic, and reliability issues.

As will be seen, the present invention offers a long-lived PET radioisotope production system which is rapidly scalable, highly reliable by its fault-tolerant modular design, and provides for economical, widespread availability of these isotopes.

The characteristics of the system of the present invention are directed to (a) the invention's proposed unique continuous-wave (CW) negative ion linear accelerator with optimal 14 MeV final energy; (b) the invention's fault-tolerant accelerator design, lending high reliability to its operation; (c) the invention's capability to accelerate multi-milliampere total beam currents to such optimal final energy; (d) such invention's unique HEBT design capability for simultaneous delivery of proton beam to up to six target stations, while it also preserves all desirable parent beam parameters using laser photo-detachment as the beam splitter mechanism; (e) such invention's unique uniformization of the transverse proton beam profile incident on the target plates; (f) such invention's two target capsule designs provide for uniquely high power acceptance for both iodine-124 and for zirconium-89 radioisotope production; and (g) such invention's target capsules incorporate axial symmetry of cooling channels, obviating the need for an axial positioning system, and affording high reliability in post-irradiation capsule transfer from target station to hot cell for radioisotope processing.

The two radioisotopes which are most commonly used in immuno-positron emission tomography, or immuno-PET, are iodine-124 and zirconium-89, with half-lives of 4.18 days and 3.27 days, respectively. A widely-recognized, longstanding technological barrier has precluded their reliable, economical, widespread availability. The present invention for a CW ion linac PET radioisotope system provides for their highly scalable, reliable, and economical supply.

Various objects, advantages and novel features, and further scope of applicability of the CW ion linac PET radioisotope system will be set forth in part in the detailed description to follow, taken in conjunction with the accompanying drawings, and in part will become apparent to those skilled in the art upon examination of the following, or may be learned by practice of the invention. Other objects and advantages of the invention may be realized and attained by means of the instrumentalities and combinations particularly pointed out in the appended claims.

The CW ion linac PET radioisotope system comprises a high-brightness DC volume-cusp $H^-$ ion source as the injector for the LEBT, which focusing the $H^-$ beam for acceleration by the RFQ. The RFQ structure has been proven capable of accelerating up to 30 mA of beam current at high-duty-factor. An RF coupler, or MEBT, between the RFQ and RFI accelerating structures performs matching of the beam ellipses. The RFQ and RFI linac tanks receive their RF power for acceleration of ions from modular RF amplifier (RFA) power blocks, which are fault-tolerant: each RFA power block can deliver its full rated power with up to 10% failed modules. The number of RFA power blocks may be increased to provide power for acceleration of still higher beam currents. The system, though initially configured to accelerate 6 mA of $H^-$ beam, may be rapidly and economically scaled to accelerate 10 mA, or more, to the final energy of 14 MeV.

Modularity of design and fault-tolerance are highly-desired advantages in scaling production capacity to meet demand for production of medically urgent isotopes for cancer diagnosis and therapy. Scalability in isotope production capacity is further enabled by the modular nature of the HEBT portion of the system of the invention. Highly efficient beam splitting, while maintaining beam parameters that are key figures of merit for beam quality, i.e., size, divergence, energy, energy spread, and phase spread, is an important process which is incorporated in the HEBT design of the present invention. HEBT modules may be added to support up to six high-power target stations. Optimizing target yields for the long-lived PET radioisotopes identified as critical needs by the National Cancer Institute and IAEA is addressed in the present invention by the non-linear focusing magnet lattice and high-power target station portions of the system of the invention.

Turning attention now to the drawings, referencing first of all FIG. 1, shown is a side elevation view of the CW ion linac PET radioisotope system 22. The beam axis 1B shows the direction of charged particle beam transmission in the system 22. Components 23-33 comprise the CW ion linac and deliver 14 MeV $H^-$ small diameter (low emittance) beam via beam pipe 37 to the high-energy beam transport (HEBT) 36 portion of the system 22. Each HEBT 36 system is comprised of beam splitter components 38-41 and non-linear focusing magnet lattice 43 for delivery of Waterbag profile beam via beam pipe 37 connected by bellows 47 and eight-sector high-power collimator 48 to high-power target station 49. Each high-power target station 49 has a target station cooling system 54, typically comprised of coolant working fluid reservoir, pump, and heat exchanger with connecting tubing, flow switches, gauges, and control system 55.

Completing a description of what is shown in FIG. 1, indicated by block forms at 28, 35, and 55, are appropriately programmed digital computers which are operatively connected to various electronically controllable components in system 22. These direct the overall operation of the system, while the computers, their operational software, and their specific connections to system 22, do not form any part of the present invention.

Figure 2:
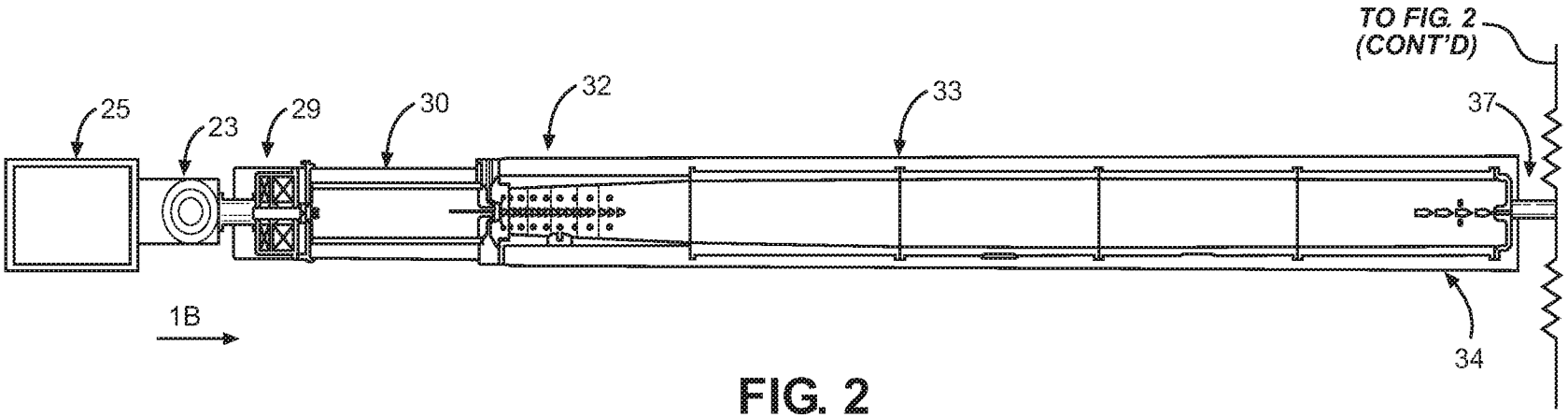
FIG. 2 presents the simplified schematic from an overhead (top) view of the system components which are also shown in FIG. 1.
Figure 2:
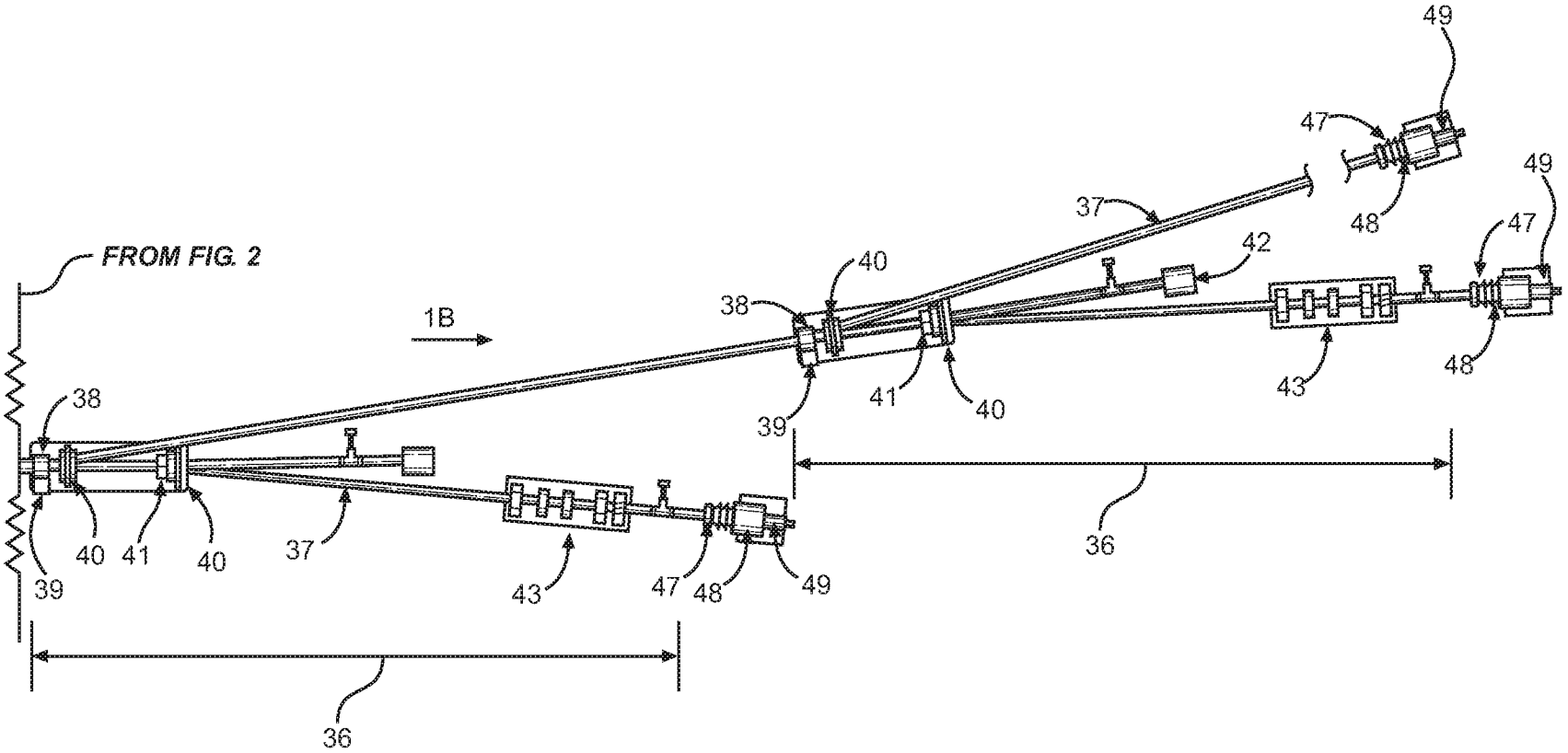
Figure 9:
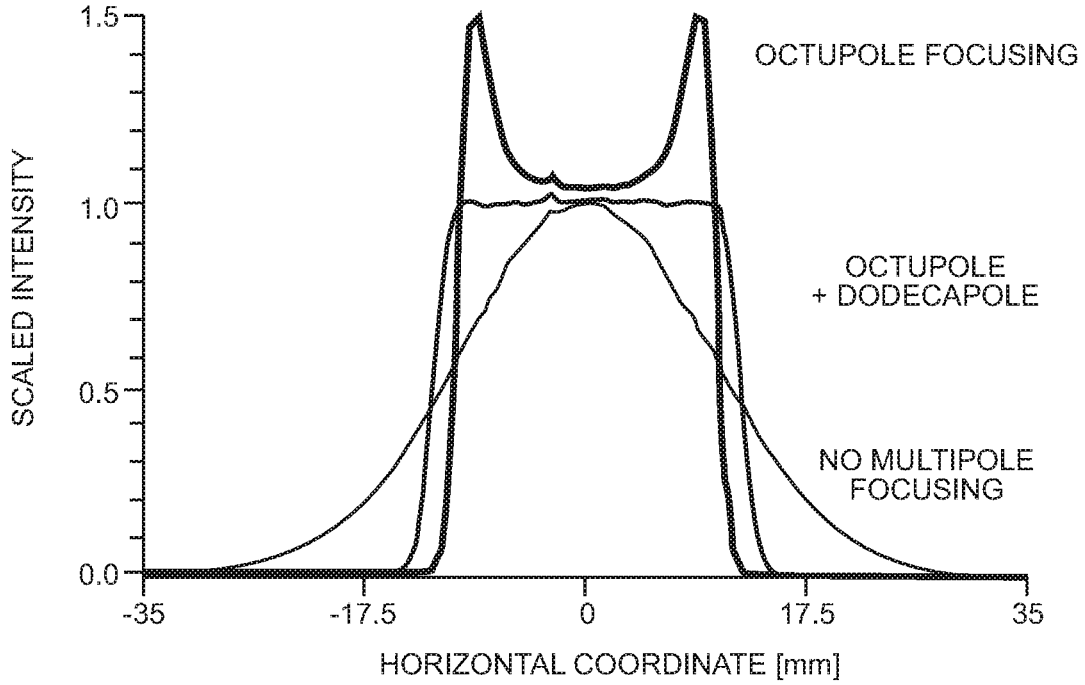
FIG. 9 is a multi-trace graph depicting the "flat-topping" operation of the non-linear focusing magnet portion of the system of the invention on the Gaussian proton beam profile. The flat-topped beam increases power acceptance of the high-power target plate portion of the system of the invention.

Shown in FIG. 2 is an overhead, top view, of the CW ion linac PET radioisotope system 22. The modular nature of the HEBT 36 system is depicted, with two such portions of the system of the invention displayed in FIG. 2. Each HEBT 36 beam pipe 37 delivers 14 MeV Gaussian proton beam to a non-linear focusing magnet lattice 43 for uniformization to the Waterbag beam profile as shown in FIG. 9. Simultaneous irradiations at multiple high-power target stations 49 may be performed as shown in FIG. 2 and FIG. 3.

Figure 3:
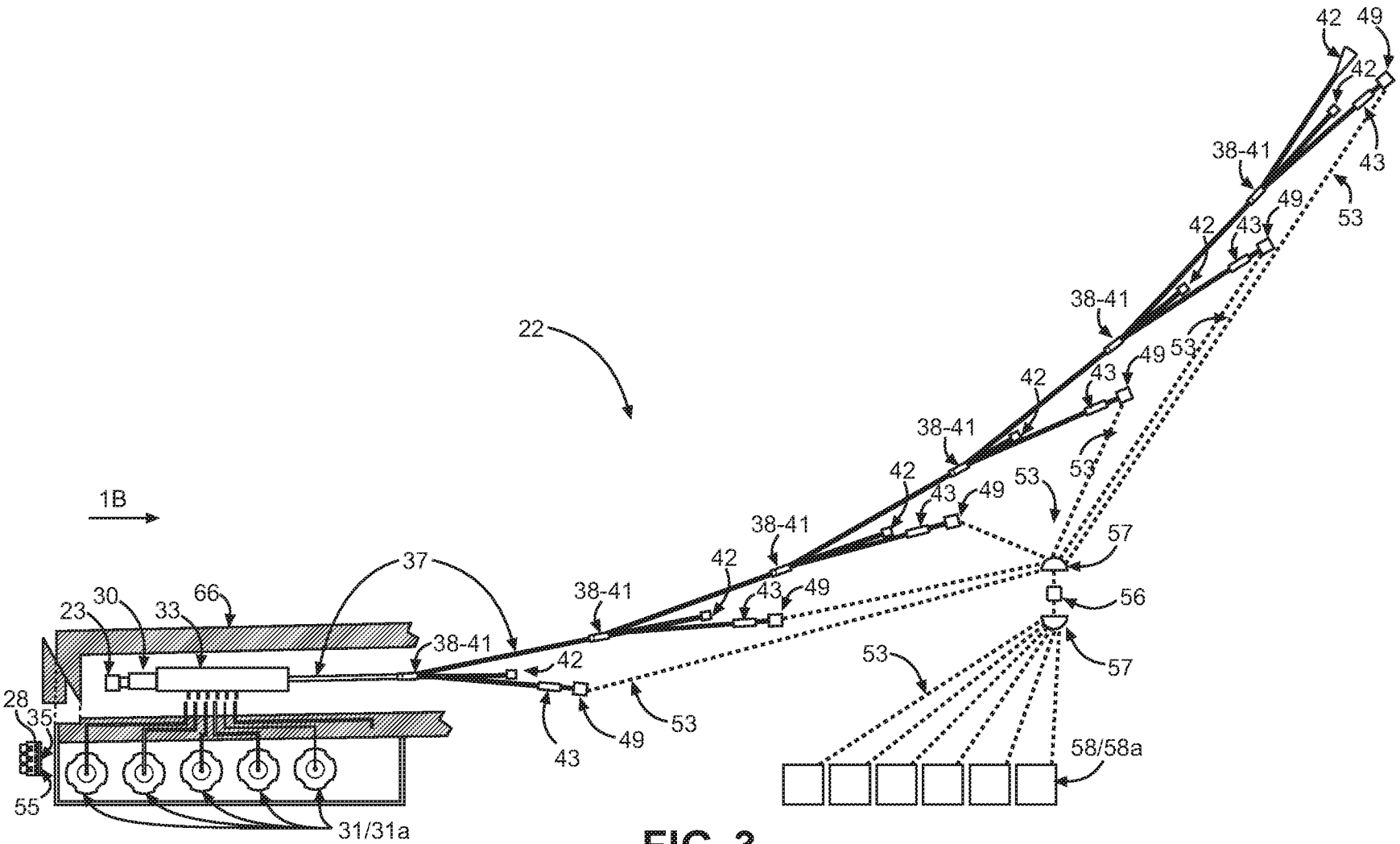
FIG. 3 presents a reduced scale overhead (top) view of the system as installed in a facility, explicitly demonstrating the scalability in a configuration with six high power target stations portion of the system of the invention.

The full CW ion linac PET radioisotope system, as shown in FIG. 3, demonstrates the highly scalable, modular nature. In FIG. 3, the CW ion linac portion of the system 22 is configured with a complement of five RF amplifier (RFA) and internal power blocks 31/31A. Controls at 35 insure that the phase of the RF power at each drive loop for RFA 31 be the same within a few degrees. With the multiple drive loop configuration shown in FIG. 3, the signals required for this control are the summation of the forward RF power on all drive lines and the summation of the reflected RF power on all drive lines. Resonance will be signaled by minimizing the voltage standing wave ratio (VSWR). Control of the phases will be signaled by maximizing the sum of the forward RF powers. The system 22 beam pipe 37 supplies a complement of six FIG. 2 HEBT 36 beamlines with six high-power target stations 49. FIG. 3 also depicts six target capsule transfer tubing lines 53, serviced by two target capsule divertors 57 short-connected by target capsule transfer tubing 53, with one target capsule blower/suction transfer station 56, for target capsule transfer to/from six radiochemical processing hot cells 58 by a manifold comprised of target capsule transfer tubing 53.

Figure 4:
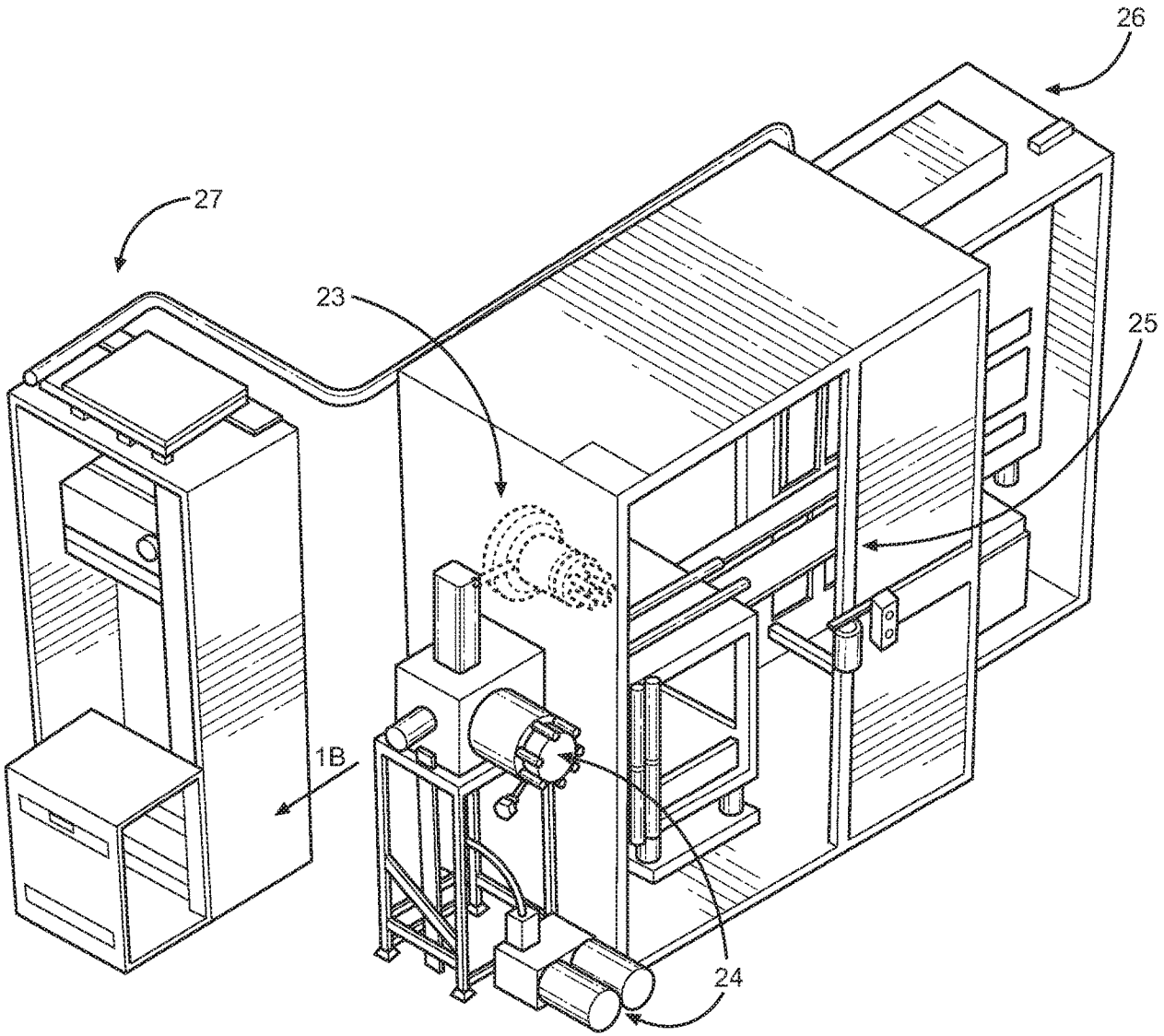
FIG. 4 presents, on a slightly larger scale than that which is employed in FIG. 1, a fragmentary, isolated, more detailed side-elevational view of the DC volume-cusp negative ion source portion of the system of the invention.
Figure 4A:
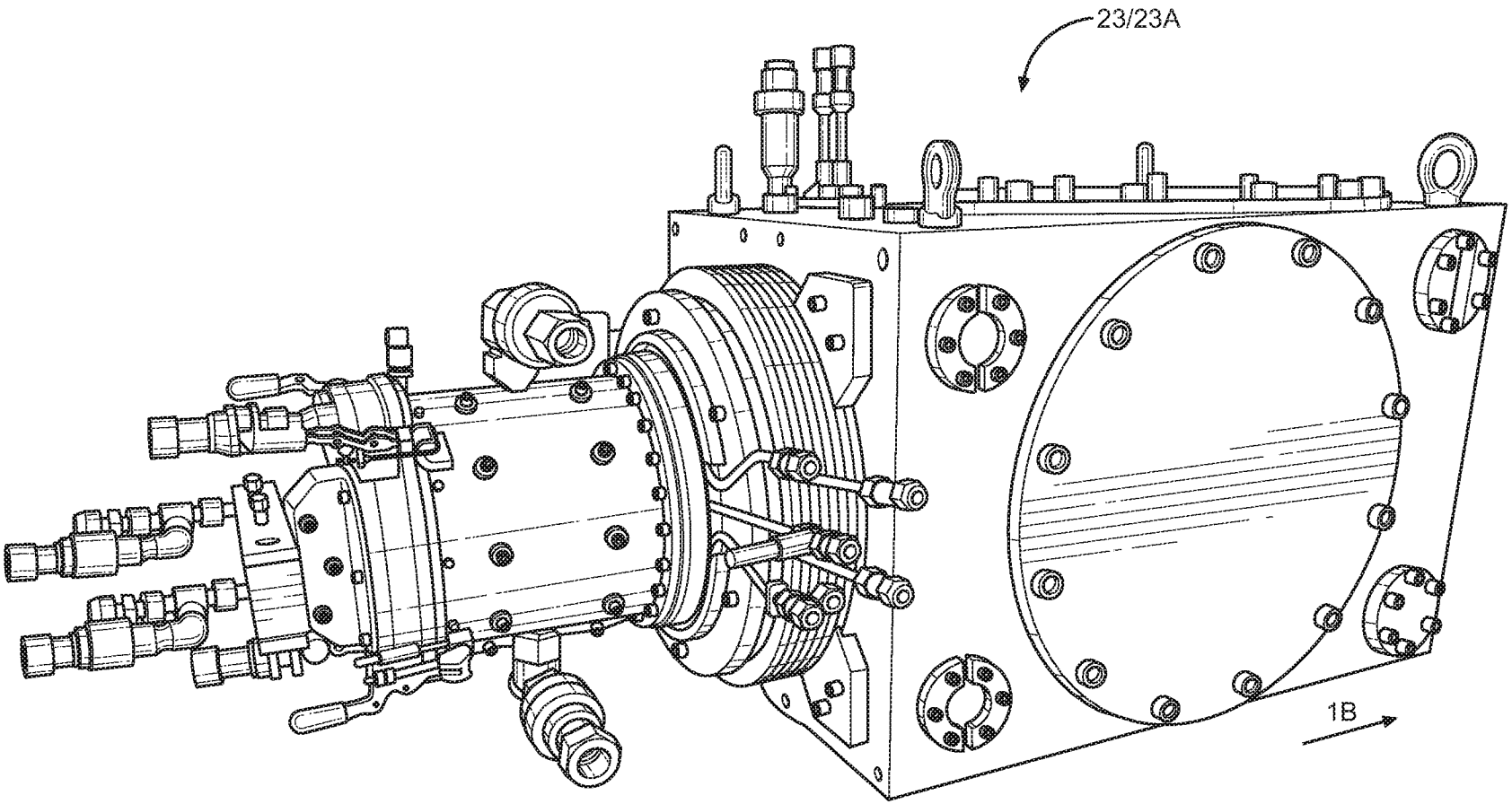
FIG. 4A presents a still further enlarged, fragmentary, isolated, three-dimensional perspective, top view of the ion injector portion of the DC volume-cusp H− ion source.

Shown in FIG. 4 is an enlarged, three-dimensional perspective illustration of the complete DC volume-cusp $H^-$ ion source system portion of the invention, with ion injector assembly 23. Vacuum pumps 24 include mechanical roughing pumps for initial pump down and backing pressure for the turbomolecular pump mounted to the side of the ion source vacuum box. A low voltage rack 27 supplies the vacuum pumps, gauges, and controls. A high-voltage (HV) rack 26 is comprised of power supplies for ion source operation of the plasma lens 68, extraction lens 69, filament, and plasma heating arc in the ion source body 67, mounted in Faraday cage 25, which has an interlock system to isolate personnel from the high-voltage portion 26 of the system when energized.

Figure 5:
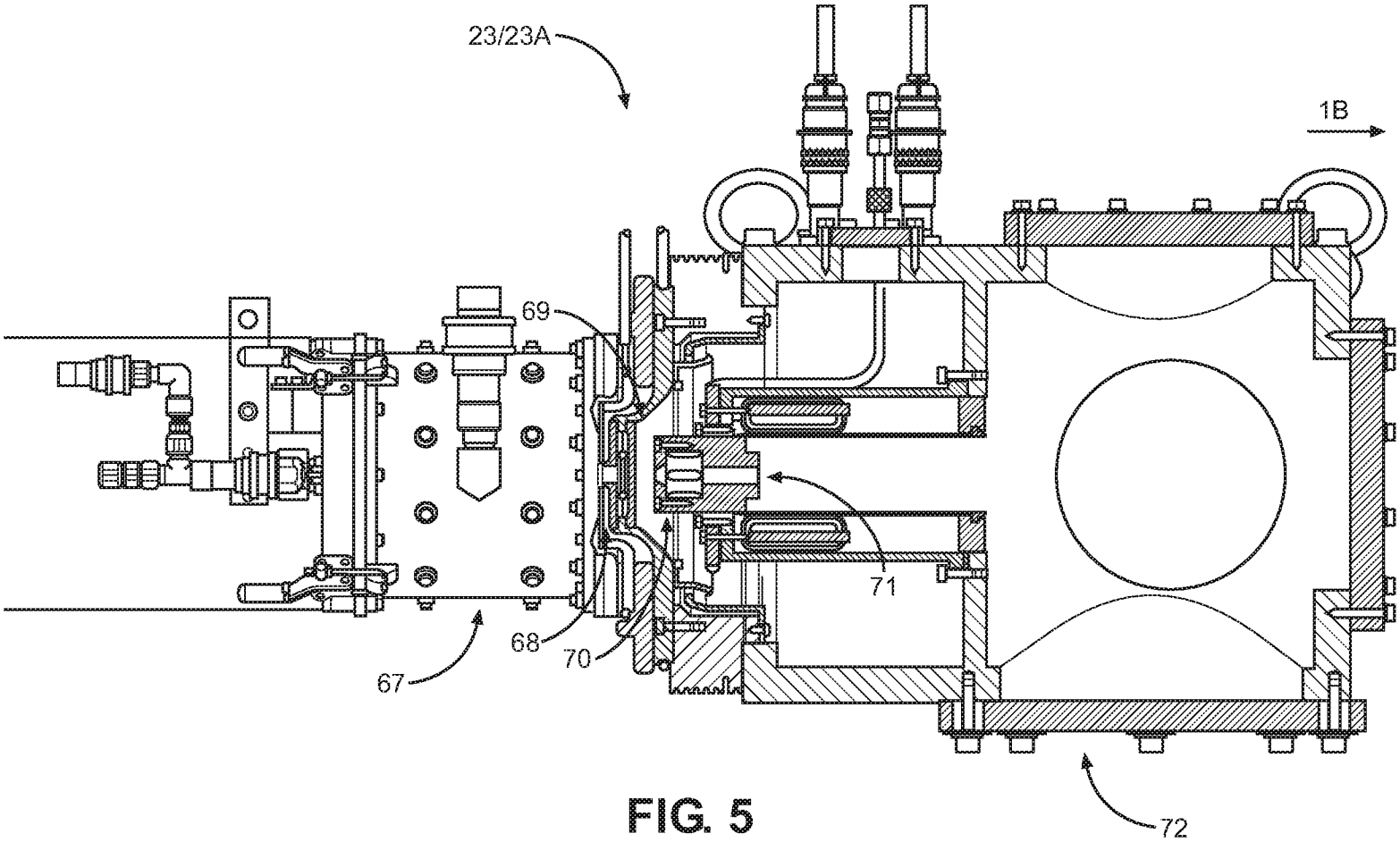
FIG. 5 is a fragmentary, isolated, "opened up" side-elevational view of just the ion injector portion of the DC volume-cusp H− ion source shown in FIG. 4A.

Referring to FIG. 5, an enlarged, cross-sectional view of the DC volume-cusp $H^-$ ion source injector 23 and its internal structure 23A; this provides $H^-$ ions at up to 15 mA at 25-30 keV with a $4\pi$ normalized emittance of less than 1.00 mm-rad emittance. The DC volume production $H^-$ ion source internal structure 23A with multi-cusp plasma confinement, shown in FIG. 5, produces a high-brightness, stable beam of ions in the 25-30 keV energy region. As is known to those skilled in the art, the ion source 23A maintains a confined plasma from which $H^-$ ions are preferentially extracted. The plasma confinement region is the ion source body 67, supplied with $H_2$ gas, where heating by a DC filament results in thermionic emission of electrons, ionizing the gas. The ion source body 67 is maintained at negative 25-30 kV. Volume-production processes exhibit lower emittance and are most useful for the generation of high-brightness $H^-$ beams. In volume production, the dominant reactions in a confined hydrogen plasma are given by this two-step process, referred to as dissociative attachment, $$e+H_2(v=0)\rightarrow H_2(v>0)+e$$

$$H_2(v>0)+e\rightarrow H_2^-(v>0)\rightarrow H^-+H$$

where v is the vibrational quantum number. Whereas the first reaction peaks for energetic electrons (~100 eV), the yield of $H^-$ in the second reaction of the process is maximized for lower energy, "cold," electrons (~1 eV). A bias voltage applied to the plasma lens 68 increases production of secondary electrons. This necessitates a magnetic filter to eliminate the energetic electrons from the "cold" region. In the extraction region, a permanent magnet filter in the extraction lens 69 removes any electrons from the beam before being brought to its final energy of 25-30 keV by the ground lens 70. The permanent magnet filter obviates the need for an electron trap in the LEBT 29 to prevent these electrons from being accelerated along with the $H^-$ ion beam by the RFQ 30. The beam waist 71 is created in the vicinity of the ground lens 70. The vacuum box 72 incorporates a small x-y steering magnet to ensure the beam ellipse is properly centered for acceptance by the LEBT 29.

Figure 6:
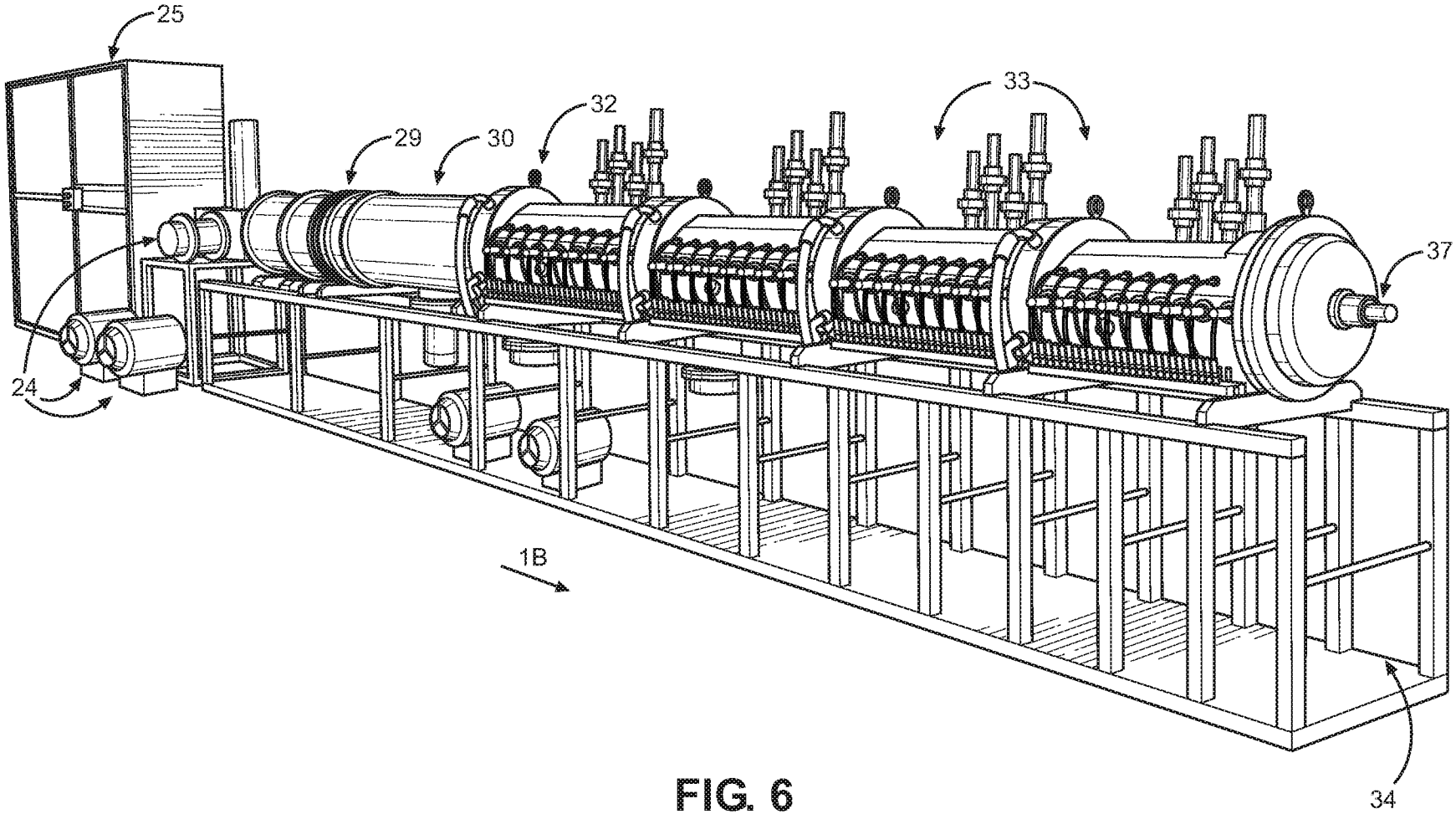
FIG. 6 is a slightly enlarged, three-dimensional perspective view of the linear accelerator picturing the DC volume-cusp H− ion source, LEBT, box-like radio-frequency quadrupole (RFQ), RF coupler MEBT, and radio-frequency interdigital (RFI) accelerating structures portion of the system of the invention.

Shown in FIG. 6 is an enlarged, three-dimensional perspective, top view of an embodiment of the CW ion linac PET radioisotope system 22. The DC volume-cusp $H^-$ ion source 23 provides a highly collimated multi-milliampere beam of $H^-$ ions. For the best injection into the RFQ 30, an azimuthally symmetric (round), strongly convergent beam is needed. The beam from the ion source 23 is round and diverging. The beam is allowed to expand at the entrance into low energy beam transport system (LEBT) at 29, which focuses the $H^-$ beam into the ideal shape and steers the $H^-$ ion beam into RFQ 30 which has a capture efficiency of 95%. The ion source has vacuum pumps 24 which provide the high vacuum for beam transmission between the ion source, through the LEBT 29, to the entrance of the RFQ 30. The RFQ linac 30 uses RF electric fields to focus and accelerate the CW $H^-$ ion beam from around 25 keV to 1.0 MeV. This small diameter $H^-$ ion beam from the RFQ 30 is injected by the MEBT (RF coupler) at 32, into the multiple-tank RFI linac at 33. A simple, resonance-control system, based on temperatures of the linac structures, keeps the relatively broad-band RFQ 30 in resonance with the RFI tanks 33. This simplicity obviates the need for an accurate frequency source, low-level RF power amplifier chain, and the associated power supplies. The RFI linac, with its RF electric focusing and acceleration fields maintains the small beam diameter while the CW $H^-$ beam is accelerated to its final energy of 14 MeV. Also shown in FIG. 6, numerous water cooling channels are machined directly into the wall of the RFI linac tank 33. Controls are used in the multiple-tank RFI linac 33 for controlling the relative phase of the accelerating gradients in each tank such that incoming $H^-$ ion bunches arrive at the center of each accelerating gap at the proper phase for acceleration. The $H^-$ ion beam can then be injected into the high-energy beam transport (HEBT) 36 system portion of the invention where it is utilized for production of long-lived PET imaging isotopes for medical applications. The basic parameters for a preferred embodiment of the CW ion linac are presented in Table 1.

TABLE 1

| | | |
|---|---|---|
| Accelerated Particle | H- | — |
| Resonant Frequency | 200 | MHz |
| Ion Source Output Energy | 27 | keV |
| RFQ Output Energy | 1.0 | MeV |
| RFI Output Energy | 14.0 | MeV |
| Beam Current | 10.0 | mA |
| Beam Duty Factor | 100% | — |
| RFI Tanks | 4 | — |
| RFI Linac Length | 5 | m |
| RF Cavity Power (Peak) | 590 | kW |
| RF Beam Power (Peak) | 140 | kW |
| RF Total Power (Peak) | 720 | kW |
| RFQ Transmission Efficiency | 95 | % |
| RFI Transmission Efficiency | 100 | % |
| Total Length, Including Ion Source | 8.26 | m |

Figure 6A:
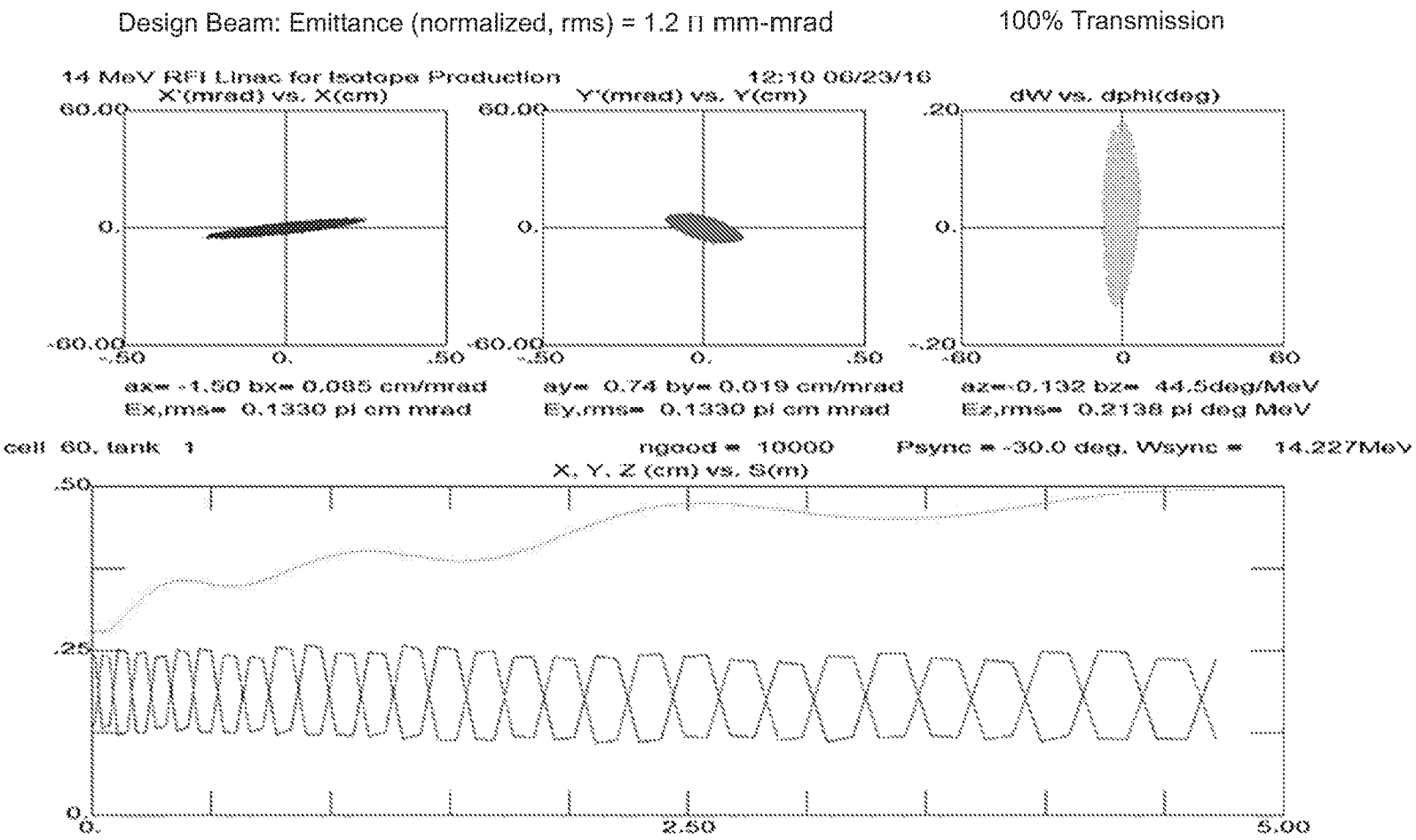
FIG. 6A is a TRACE 3D particle-tracking simulation showing a number of beam parameters of the 14 MeV CW ion linac.

In FIG. 6A is a plot of a TRACE3D particle-tracking simulation of the 14 MeV CW ion linac portion of the system of the invention 22. The phase spaces and profiles are for the entire sample of ten thousand particles. The output of the 14 MeV RFQ/RFI linac demonstrates the small beam diameter achieved, with a normalized, rms emittance of 1.2 π mm mrad. The FIG. 6A values of the CW ion linac's emittance, Twiss alpha parameters (ax and ay, both unitless), and Twiss beta (bx and by, cm/mrad) are used to determine the octupole and dodecapole magnet strengths in the non-linear focusing magnet lattice 43. The Twiss parameter values can be changed through the use of a single quadrupole 45 lens if needed.

Figure 7:
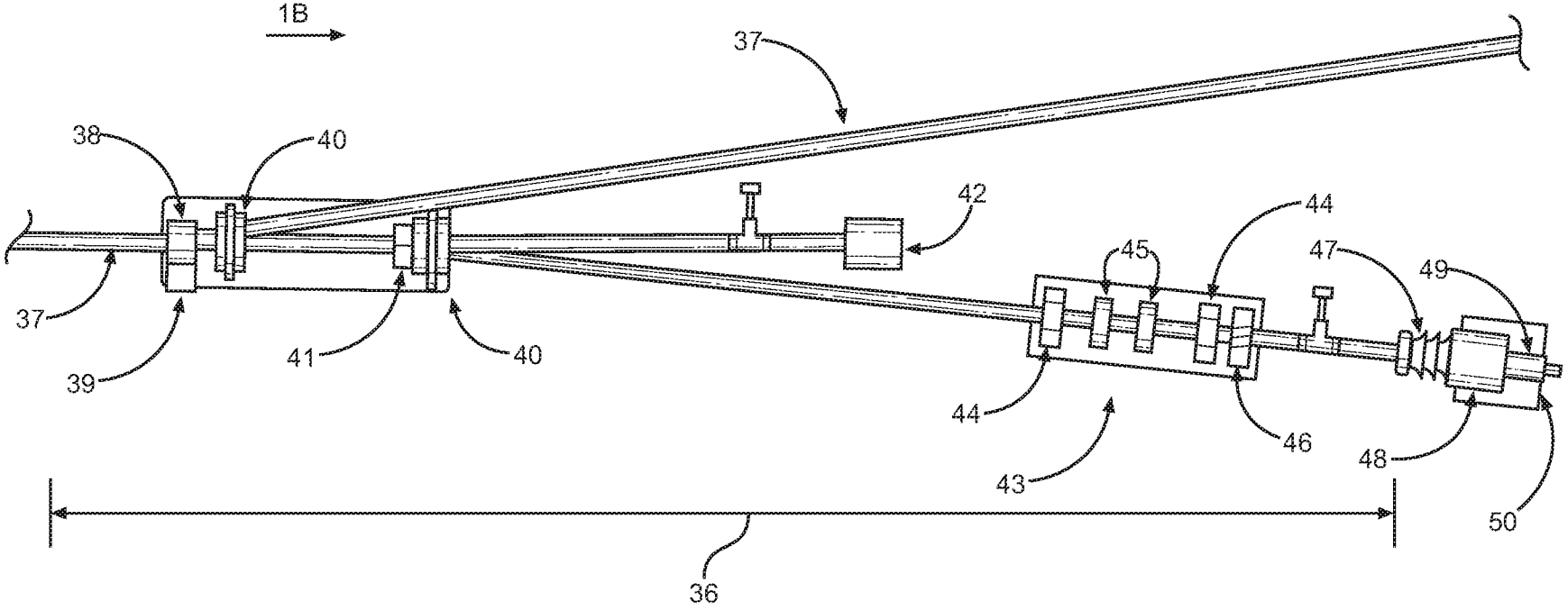
FIG. 7 is a slightly enlarged, fragmentary, isolated overhead (top) view of a segment of the HEBT portion of the system of the invention, showing the laser-wire beam splitter and non-linear focusing magnet lattice components which make up this portion of the system of the invention.

Now referring to FIG. 7 is a slightly enlarged, top view of the modular HEBT 36 portion of the system of the invention 22. Beam pipe 37, a drift tube, transfers $H^-$ beam from the RFI linac 33 to the optical box 38, in which the interaction cavity for the CW laser 39 beam crosses the $H^-$ beam axis 1B. Photo-detachment of the first electron of the $H^-$ ions for a fraction of the linac beam yields neutral $H^0$ beam, which passes through a hybrid boron-carbon (HBC) foil in foil holder 41. High stripping efficiency results in near 100% of the $H^0$ beam exiting foil holder 41 as protons. This is necessary to extract protons, while it Coulomb multiple scatters the beam, ensuring a Gaussian beam distribution. Residual $H^0$ beam is collected in a water-cooled beam dump 42. Dipole bending magnets 40 provide horizontal deflecting forces to direct both the remaining $H^-$ ions to the next optical box 38 via beam pipe 37, and the proton beam to the non-linear focusing magnet lattice 43. The proton beam is manipulated by two octupole magnets 44, to form a beam with a two-dimensionally uniform transverse intensity distribution. The octupole magnets 44 are separated at the x- and y-beam waist points by a doublet of quadrupole magnets 45 to suppress the betatron coupling which the octupoles introduce. The use of two octupole magnets 44 enables the tuning of octupole-focusing effects independently in the two transverse dimensions, minimizing this coupling effect. To obtain an rms uniformity of 5% or better, the flat-top Waterbag distribution, requires the higher order multipole of the dodecapole magnet 46. The flat-topped proton beam is delivered to the high-power target station 49 via the high-power eight-sector collimator 48, which provides for final shaping of the beam, feedback for beam steering, and essential safety interlock functionality for under-focused, over-focused, and slightly drifted beam conditions.

Figure 8:
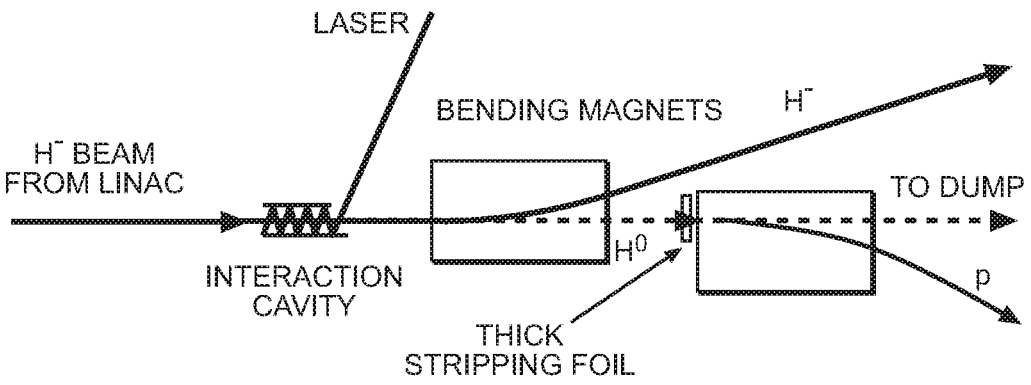
FIG. 8 is an isolated block diagram depicting the functional characteristics of the laser-wire beam splitter components.

Referring to FIG. 8, a schematic representation of the beam splitter portion of the system of the invention reveals how the linac $H^-$ beam undergoes charge exchange reactions to extract high current proton beam. The relativistic $H^-$ beam from the linac 33 can be stripped by laser photo-detachment of the first electron since the threshold is only 0.75 eV. The $H^-$ beam enters an interaction cavity in optical box 38 via beam pipe 37, as shown in FIG. 7, where the laser beam crosses the linac beam multiple times due to high reflectivity surfaces, shown in FIG. 8.

As an example it can be shown that this technique is effective for low energy (~10-15 MeV) beams because the yield is inversely proportional to β, the particle velocity in units of the velocity of light. Here, we have β=0.17 for $H^-$ ions at 14 Mev. The detachment cross-section is $3.5\times10^{-17}$ $cm^2$ at 1.17 eV (1064 nm). In the $H^-$ rest frame, the relativistic shifted, or "Lorentz boosted," laser photon energy is $E_{CM}=\gamma E_L\,[1-\beta\cos(\theta_L)]$, with β and γ the Lorentz parameters of the $H^-$ beam and $\theta_L$ is the laboratory angle of the laser beam relative to the $H^-$ beam. For a Gaussian laser beam with $N_L$ photons intercepting a Gaussian $H^-$ beam of current $I_b$ at angle $\theta_L$, the yield $Y_1$, the number of neutral hydrogen atoms produced per laser-$H^-$ beam crossing, is given by the following approximation:

$$Y_1 = \frac{I_b N_L}{e\beta c}\frac{1-\beta\cos\theta_L}{\sin\theta_L}\frac{\sigma_N(E_{CM})}{2\pi\sigma_b\sigma_L}\int_{-\infty}^{\infty} e^{-(x^2/2\sigma_b^2)}e^{-(x^2/2\sigma_L^2)}dx = \frac{I_b N_L}{\sqrt{2\pi}\,e\beta c}\frac{1-\beta\cos\theta_L}{\sin\theta_L}\frac{\sigma_N(E_{CM})}{\sqrt{\sigma_b^2+\sigma_L^2}}$$

where $\sigma_b$ and $\sigma_L$ are the transverse rms sizes of the $H^-$ and laser beams normal to the plane of incidence, and $\sigma_N(E_{CM})$ is the photo-detachment cross-section at photon energy ECM in the $H^-$ rest frame. For illustration, in one embodiment using a 10 mA, 14 MeV $H^-$ beam, $N_L=2.68\times10^{17}$, $\theta_L=85°$, $\beta c=5\times10^9$ cm/s, $\sigma_N$ $(E_{CM})=3.5\times10^{-17}$ cm$^2$, $\sigma_b=\sigma_L=0.2$ cm. Yield is enhanced above the fractional yield $F_1$ of a single crossing by reflecting the laser beam through the $H^-$ beam a number of times, N, to give the approximate fractional yield, $$F_N=1-(1-F_1)^N$$

with $Y_1$ at $1.5\times10^8$ $H^0$ atoms per 10 ns CW mode-locked laser 39 pulse, ~0.5 mA, for N=8 mirror reflections, the total $H^0$ current is ~5 mA, effectively splitting the beam. The neutral $H^0$ beam maintains nearly identical parameters as the parent $H^-$ beam, including size, divergence, energy, energy spread, and phase spread.

The remaining electron is stripped by a long-lifetime hybrid boron-carbon (HBC) foil in foil holder 41 with an efficiency of nearly 100% given by the fractional yield as a function of $H^0$ beam velocity in units of the speed of light, parametrized as follows:

$$H^+ = 1 - H^0$$

$$H^0 = \left(\frac{a}{a+b-c}\right)[\exp(-cdt) - \exp(-(a+b)dt)]$$

where a=0.479×10−18 cm$^2$/$\beta^2$ b=0.0085×10−18 cm$^2$/$\beta^2$ c=0.187×10−18 cm$^2$/$\beta^2$ d=foil density in atoms/g t=foil thickness in μg/cm$^2$ β=relativistic factor (0.17 at 14 MeV)

The remainder of the neutral beam (<100 W) is directed to a beam dump 42. As shown in FIG. 2, FIG. 3, and FIG. 7, the parent H− beam, viewed along beam direction 1B, is diverted by a dipole bending magnet 40 providing a 10° transverse kick to the left, while the proton beam receives a 5° transverse kick to the right from a second dipole bending magnet 40, directing the proton beam to the non-linear focusing magnet lattice 43 for "flat-topping" to the desirable Waterbag beam profile.

Referring to FIG. 9 is a multiple-trace plot of scaled proton beam intensity as a function of distance from the center of the beam axis 1B. FIG. 9 presents the effects of proton beam manipulation by the non-linear magnet lattice 43 on the CW ion linac 33 Gaussian beam profile, shown as the relatively peaked "NO MULTIPOLE FOCUSING" trace. Beam optics considerations by those skilled in the art for generating a 2D uniform distribution require octupoles for both transverse directions. Nonlinear multipole magnetic forces inevitably couple the vertical and horizontal motion. The nonlinear focusing magnet lattice 43 places the x-direction octupole 44 near the y-direction beam waist, with two focusing quadrupoles 45 next. The second octupole 44, spreading in the y-direction, is near the x-direction beam waist point. However, the uniform beam area is still surrounded by an overshoot "wall" of higher intensity, as shown by the "OCTUPOLE FOCUSING" trace in FIG. 9. The area of uniform intensity decreases with increased octupole field strength. This is because the tail of the Gaussian distribution is folded inside the octupole field when the octupole magnet is excited. Higher odd-order fields are required for perfect uniformization of the Gaussian beam. Addition of the dodecapole magnet 46 results in the "flat-topped," or Waterbag, beam profile indicated by the "OCTUPOLE+DODECAPOLE" trace in FIG. 9, for delivering a constant proton fluence rate to each collimator 48 at each target station 49 of the CW ion linac PET radioisotope system 22 shown in FIG. 3.

Figure 10:
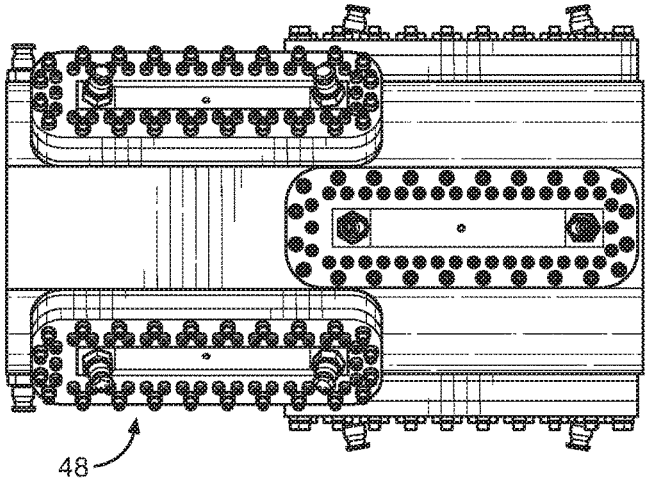
FIG. 10 is an enlarged, fragmentary, isolated, top view of a high-power eight-sector collimator 48 for receiving the "flat-topped" beam profile of FIG. 9.
Figure 10A:
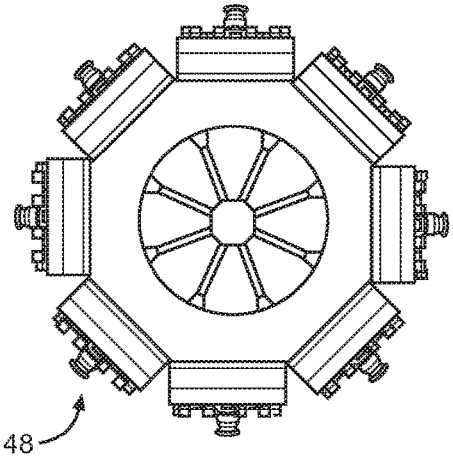
FIG. 10A is an enlarged, fragmentary, isolated front view along the beam axis 1B of the high-power eight-sector collimator 48.
Figure 10B:
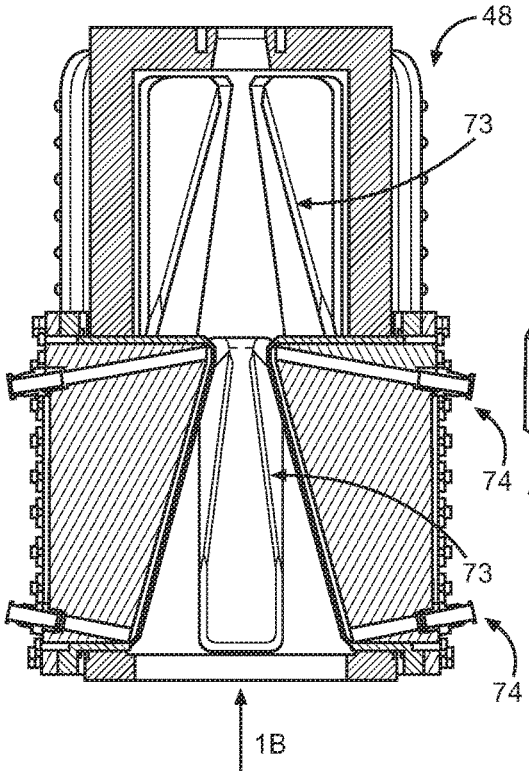
FIG. 10B is an enlarged, fragmentary, isolated cross-sectional view of the high-power eight-sector collimator 48.
Figure 10C:
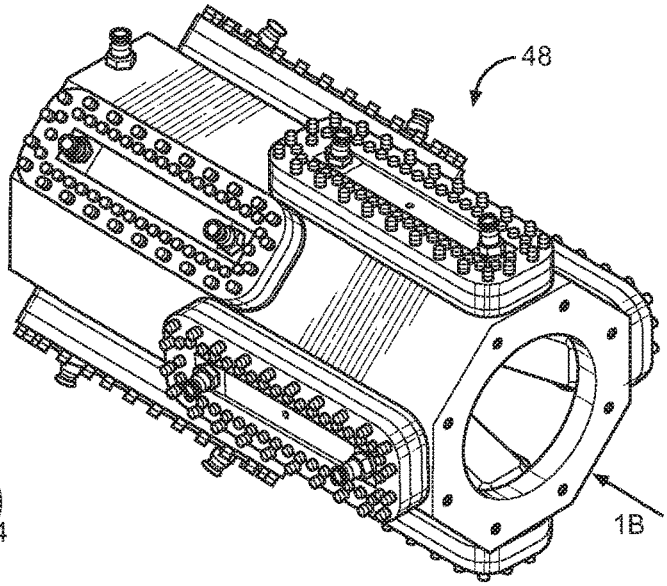
FIG. 10C is a three-dimensional, top perspective view of the high-power eight-sector collimator 48

In FIG. 10 is a side view of the high-power eight-sector collimator 48. It permits dividing the high incident heat load of the steep edge of the Waterbag beam profile among eight water-cooled sectors. The sectors are machined from low-alloyed aluminum to minimize radio-activation. The sectors are shown in FIG. 10A, a cross-sectional view of the high-power eight-sector collimator 48. With high-power metallic target currents as high as 4.0 mA, at 56 kW of power acceptance, each of the sectors should accept at least 250 μA, or 3.5 kW of power. For practical ease of operation, the enhanced power acceptance is needed to provide for individual adjustment of octupole magnet 44 strengths in each direction. The power acceptance of the collimator 48 is also a necessary feature to provide safety signals for under-focused, over-focused, and slightly drifted beam conditions (off-center relative to beam axis 1B) of the proton beam to the accelerator control system (ACS) computer 35 to minimize the potential for equipment damage due to such high beam intensities.

Figure 11:
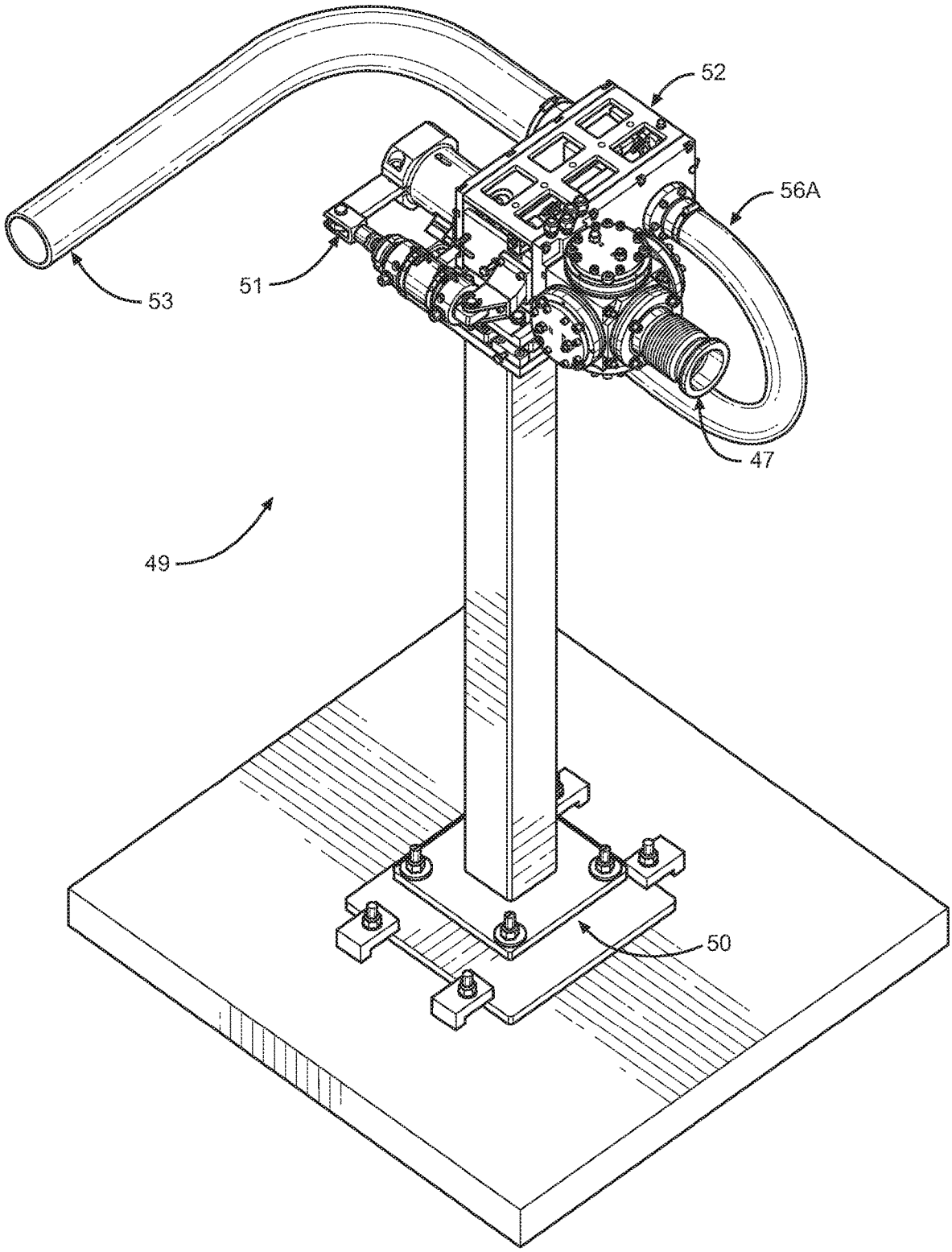
FIG. 11 is a fragmentary, isolated, upper perspective view of the high-power target station portion of the system of the invention.

Shown in FIG. 11 is a high-power acceptance target station 49 portion of the system of the invention. The target station 49 and bellows 47 are electrically isolated from the adjustable stand 50 and the incoming beam pipe 37 for target current measurement. The adjustable stand 50 provides fine x-, y-, and z-axis position adjustment for the target station relative to the incident proton beam delivered via beam pipe 37. Target capsule transfer tubing 53 delivers the remotely assembled target capsule comprised of high-power metallic target plate 60, target capsule male portion 61, and target capsule female portion 62 to the target capsule receiving station 52 of the target station 49. Pneumatic actuators of target capsule receiving station 52 position the assembled target capsule in the target capsule locking mechanism 51, which with pneumatic force closes the rubber-like elastomer seals of the axially symmetric cooling channels of target capsule male portion 61 and target capsule female portion 62 into the target station 49 for irradiation by proton beam via beam pipe 37. Following irradiation, pneumatic unlocking by target capsule locking mechanism 51, extraction of the assembly of high-power metallic target plate 60, target capsule male portion 61, and target capsule female portion 62 to target capsule receiving station 52 positions it for transfer via target capsule blower/suction station tubing 56A.

Figure 12:
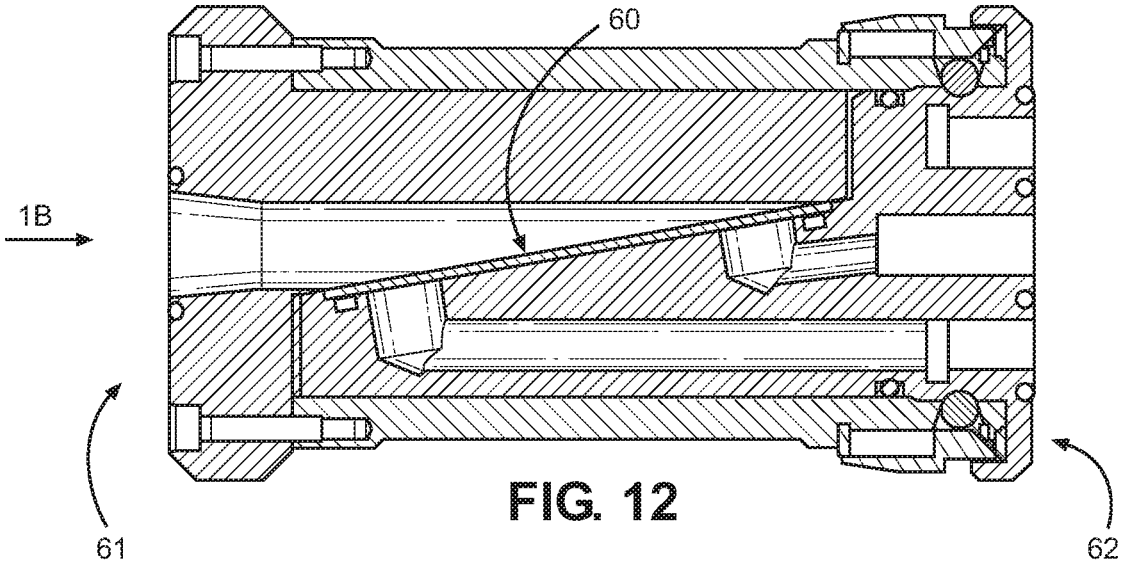
FIG. 12 is an enlarged, fragmentary, isolated schematic illustration of the target capsule for the high-power metallic target capsule portion of the system of the invention.

In FIG. 12 is a cross-sectional side view of the high-power metallic target capsule comprised of target capsule male portion 61 and target capsule female portion 62 remotely assembled in radiochemical processing hot cell 58 using target capsule remote manipulator opening/closing device 59 by means of twist-to-lock bayonet-type fittings. From the left, it accepts 35 mm diameter Waterbag beam onto target plate 60 at a 10° glancing angle relative to the beam direction 1B. Axial symmetry about beam axis 1B means that no axial positioning system is required. Such positioning systems represent one of the most common failure modes of target capsule transfer systems. The back side of target plate 60 is cooled with a eutectic Ga—Sn alloy coolant in the turbulent flow regime. Indium wire seals are used for semi-permanent assembly of high-power metallic target capsule female portion 62, minimizing maintenance needs, and limiting the use of rubber-like elastomers. Such elastomers, used in O-ring sealing technology, have inherent thermal performance limitations and are degraded by ionizing radiation.

Figure 13:
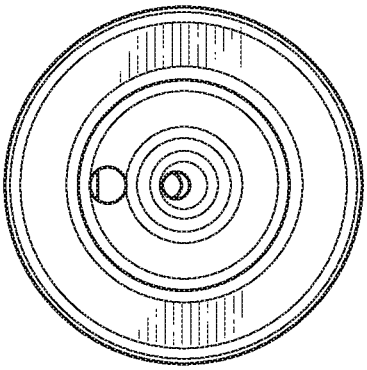
FIG. 13 is an enlarged, fragmentary, isolated schematic illustration of the target capsule showing the axial symmetry of the coolant inlet and outlet channels.

In FIG. 13 is a cross-sectional end view of the high-power metallic target capsule female portion 62 showing the co-axial symmetry of the coolant inlet and outlet channels relative to beam direction 1B.

Figure 14:
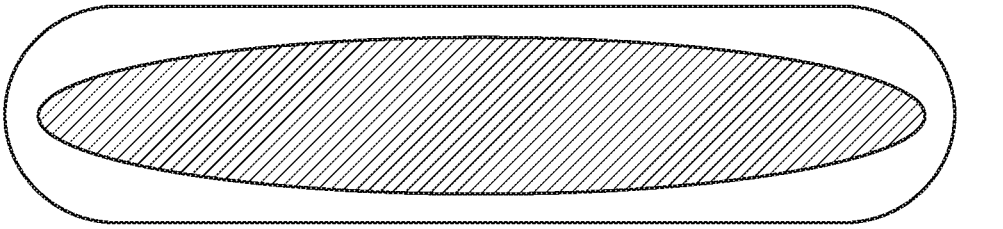
FIG. 14 is an enlarged, fragmentary, isolated schematic illustration of the high-power metallic target plate showing the elongated, elliptical deposition area for the target material.

Next in FIG. 14 is a top view of the high-power metallic target plate 60, and the elongated, elliptical, cross-hatched area represents the target substrate location. The target plate 60 is inclined at a 100 glancing angle between the target and the beam axis 1B. Typical embodiments utilize either a natural yttrium layer, explosion welded to an oxygen-free, high conductivity (OFHC) copper target plate due to its very high electrochemical potential, or nickel-64, electroplated to a silver target plate.

Figure 15:
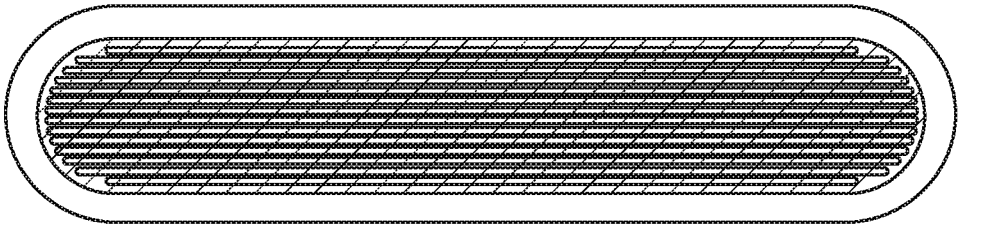
FIG. 15 is an enlarged, fragmentary, isolated schematic illustration of the high-power metallic target plate showing the increased surface area of the cooling fins. This area is plated by chromium for corrosion resistance.

In FIG. 15 is a bottom view of the high-power metallic target plate 60, showing the cooling fins used to increase the available surface area for heat transfer to the eutectic Ga—Sn alloy coolant. The bottom of the target plate is coated with chromium to protect the copper from corrosion by gallium. Chromium possesses excellent heat conductivity at 94 $W\text{-}m^{-1}\text{-}K^{-1}$. Due to the corrosion rate of chromium due to exposure to gallium at 390° C. capable of dissolving a 15 μm thick layer in 24 hours, a 30 μm thick protective chromium layer is used on the back side of target plate 60 in FIG. 15.

Multiphysics simulations can predict how target plate 60 performs under real-world conditions. Here, finite element analysis (FEA) utilized a 3D mesh for high-power metallic target plate 60 with $1\times10^6$ nodes and $5.7\times10^6$ elements. Eutectic Ga—Sn coolant at 15 $dm^3\ min^{-1}$ across the back of the target plate 60 as shown in FIG. 15 yields a pressure drop of 7.0 bar through the target capsule. This figure is safe for the yield strength of the copper used in the high-power metallic target plate 60, so no deformation is anticipated. A 14 MeV proton beam at 4.5 mA, 63 kW beam power, on the high-power metallic target plate 60 yields a maximum yttrium temperature of 453° C. The maximum coolant temperature is 307° C. This is far from the melting point of any of the target metals, but is approaching the 327° C. operating limit for the high-temperature O-ring seals. A reasonable margin to allow for beam current fluctuations is 4.0 mA, 56 kW beam power, on the high-power metallic target plate 60. This is over 20-fold greater power acceptance than present 2 kW cyclotron targets.

Figure 16:
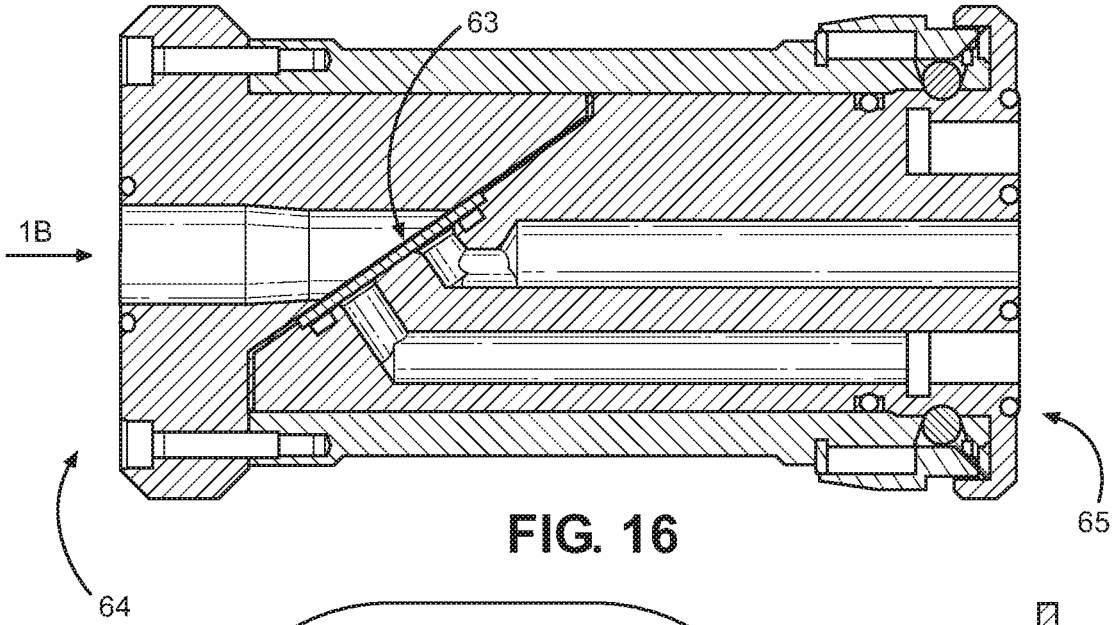
FIG. 16 is an enlarged, fragmentary, isolated, schematic illustration of the target capsule for the low thermal conductivity oxide target capsule portion of the system of the invention.
Figure 17:
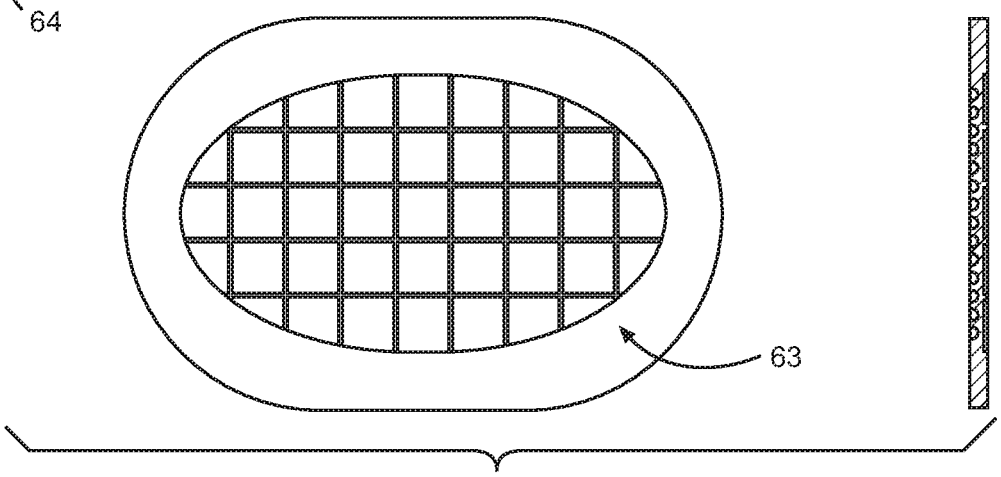
FIG. 17 is an enlarged, fragmentary, isolated, schematic illustration of the target plate for the low thermal conductivity oxide target capsule portion of the system of the invention. The depressions in the top view of the target plate are filled with enriched target substrate.

Referring now to FIG. 16 is a cross-sectional side view of the low thermal conductivity (e.g., oxides) target capsule, consisting of low thermal conductivity target plate 63, low thermal conductivity target capsule male portion 64, and low thermal conductivity female portion 65. The target capsule is windowless, designed to accept 35 mm diameter Waterbag profile beam from the left side of the low thermal conductivity target capsule male portion 64. Axial symmetry about beam axis 1B means that no axial positioning system is required. Such positioning systems represent one of the most common failure modes of target capsule transfer systems. The low thermal conductivity target plate 63 is inclined at a 35° glancing angle relative to the beam axis 1B. This glancing angle reduces the proton beam energy to 4 MeV, below the nuclear reaction threshold, reducing the thermal load on the oxide target substrate in the rectangular depressions, as shown in FIG. 17, of the low thermal conductivity target plate 63. As a water-cooled target, the limiting factor is the Critical Heat Flux (CHF), at the boiling point of water. Beyond this limit, heat flow is unstable, vapor blankets the heated surface of the back side of the low thermal conductivity target plate 63, and temperatures jump to very large values. This regime is governed by film boiling and radiative heat transfer, called burnout.

Multiphysics simulations predict how target plate 63 performs under real-world conditions. Here, finite element analysis used a 3D mesh having $1\times10^6$ nodes and $5.6\times10^6$ elements for low thermal conductivity target plate 63. The back side of target plate 63 is cooled using 20 $dm^3\ min^{-1}$ of water at 20° C. inlet temperature. The pressure drop through the target capsule under these conditions is 3.5 bar. With inlet water pressure at 10 bar, a pressure drop of 3.5 bar, the pressure of the water behind the target plate 63 is 6.5 bar. The boiling point of water at this pressure is 162° C. Multiphysics simulations with 14 MeV proton beam at 1 mA beam current yield a maximum water temperature of 157° C. The maximum tellurium oxide temperature is 410° C., much less than the 550° C. limit, where the vapor pressure of the tellurium oxide is only $5\times10^{-4}$ mbar, ensuring enriched tellurium-124 losses are less than 0.1%. Cyclotron technology has not provided a low thermal conductivity target capable of more than 150 μA with dual beam. The CW ion linac PET radioisotope system can deliver up to 6 mA total beam current to six low thermal conductivity target stations, a 20-fold increase in power acceptance.

Shown in FIG. 17 is a top view of the low thermal conductivity target plate 63, with rectangular depressions machined in the iridium target plate surface for deposition of the tellurium-124 enriched oxide target material. These depressions prohibit overflowing of the molten target material during thermo-chromatographic recovery of radioiodine.

Figure 18:
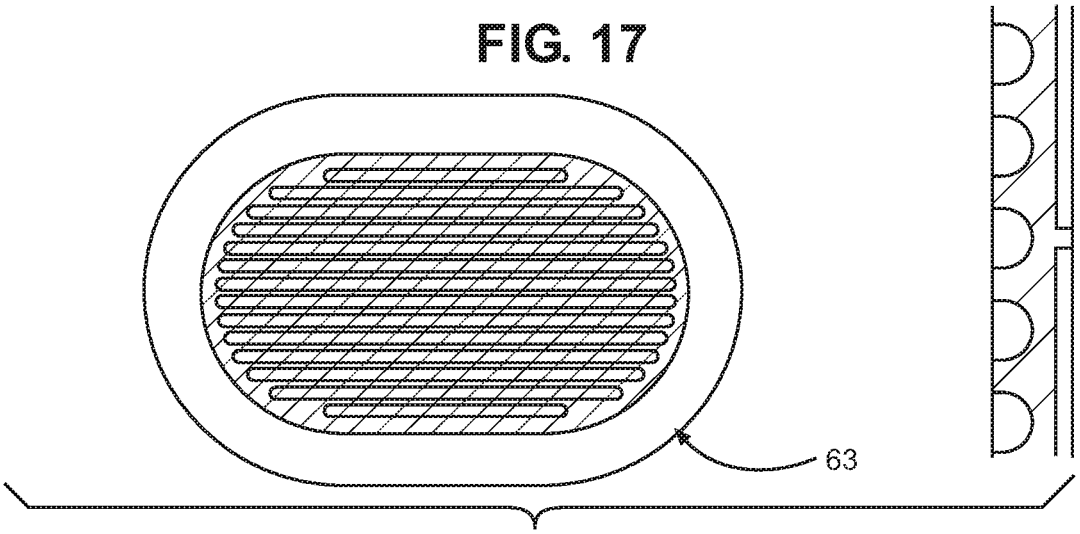
FIG. 18 is an enlarged, fragmentary, isolated schematic illustration of the low thermal conductivity target plate portion of the system of the invention showing the increased surface area of the cooling fins.

Next, in FIG. 18 is a bottom view of the low thermal conductivity target plate 63, showing the cooling fins machined in the surface of the back of the target plate to increase the surface area in contact with coolant for improved heat transfer.

Figure 19:
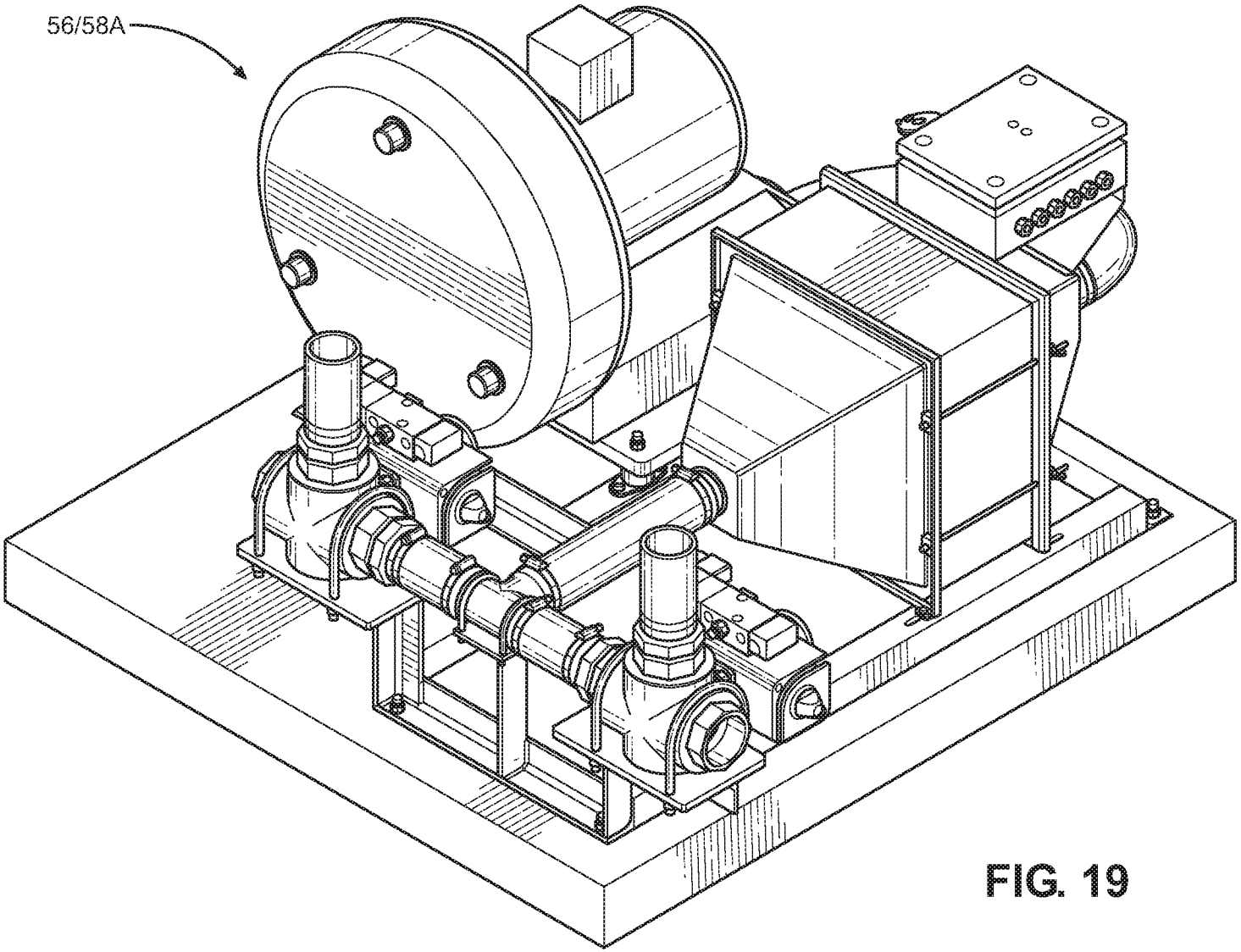
FIG. 19 is an enlarged, fragmentary, isolated schematic illustration of the blower assembly for the target capsule transfer system portion of the system of the invention.

Referring now to FIG. 19 is a three-dimensional, top perspective view of the target capsule transfer blower/suction station 56. This provides the pneumatic forces for transfer of the target capsule assemblies through the target capsule transfer tubing 53 to/from the target stations 49 from/to the radiochemical processing hot cells 58, as shown in FIG. 3.

Figure 20:
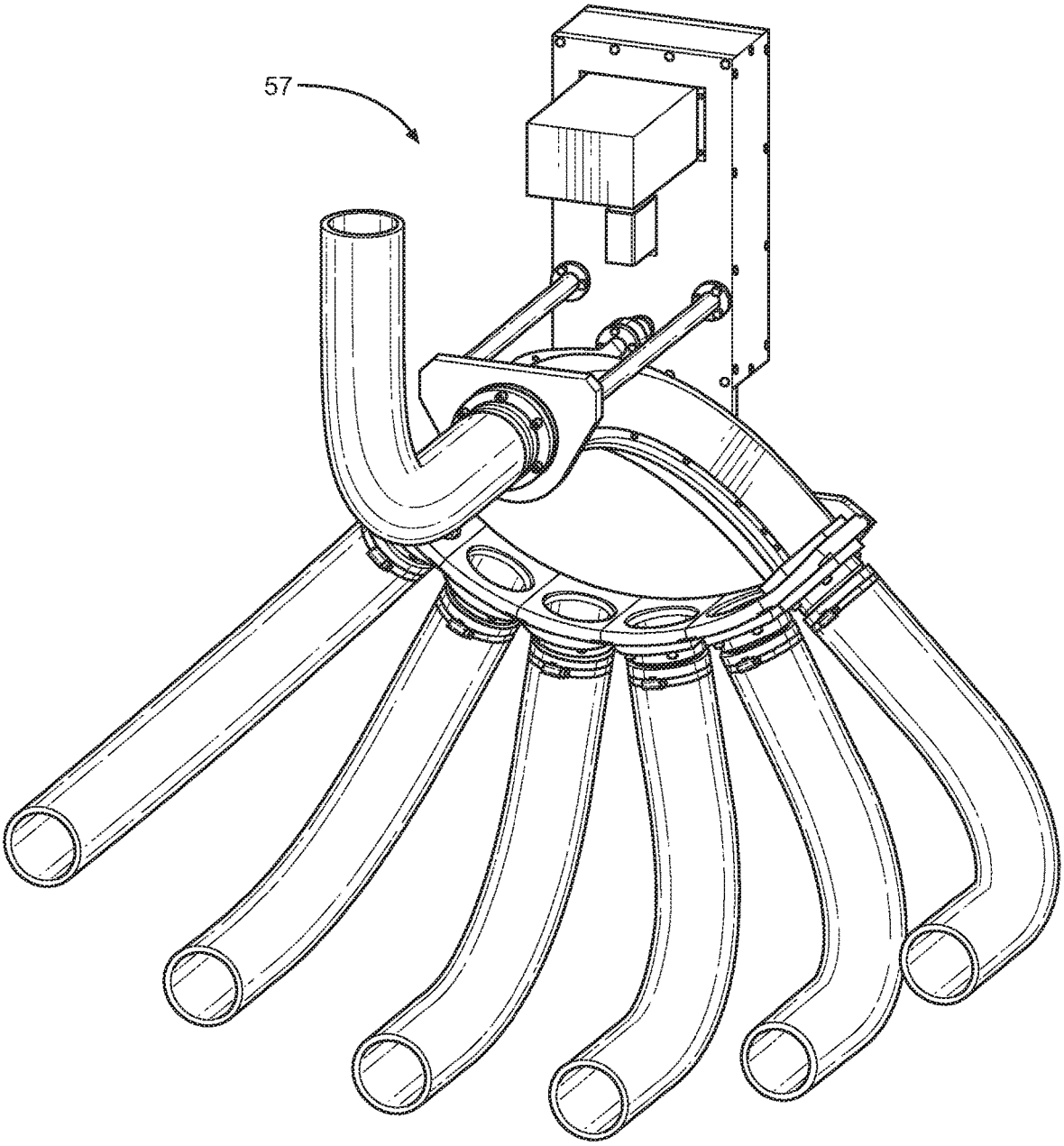
FIG. 20 is an enlarged, fragmentary, isolated schematic illustration of the divertor assembly portion of the system of the invention. It allows for the loading/unloading of up to 6 target stations to/from up to 6 hot cell destinations by the target capsule transfer portion of the system of the invention.

In FIG. 20 is a three-dimensional, top perspective view of the target capsule divertor assembly 57. It provides the mechanism for selecting the sending/receiving stations of target station 49 and radiochemical processing hot cell 58. By connecting two divertor assemblies 57, one reversed as shown in FIG. 3, one can transfer target capsule assemblies between any of a maximum of six target stations 49 and six radiochemical processing hot cells 58. An appropriately configured manifold of target capsule transfer tubing 53 provides for flexibility to meet various isotope scalability requirements.

Figure 21:
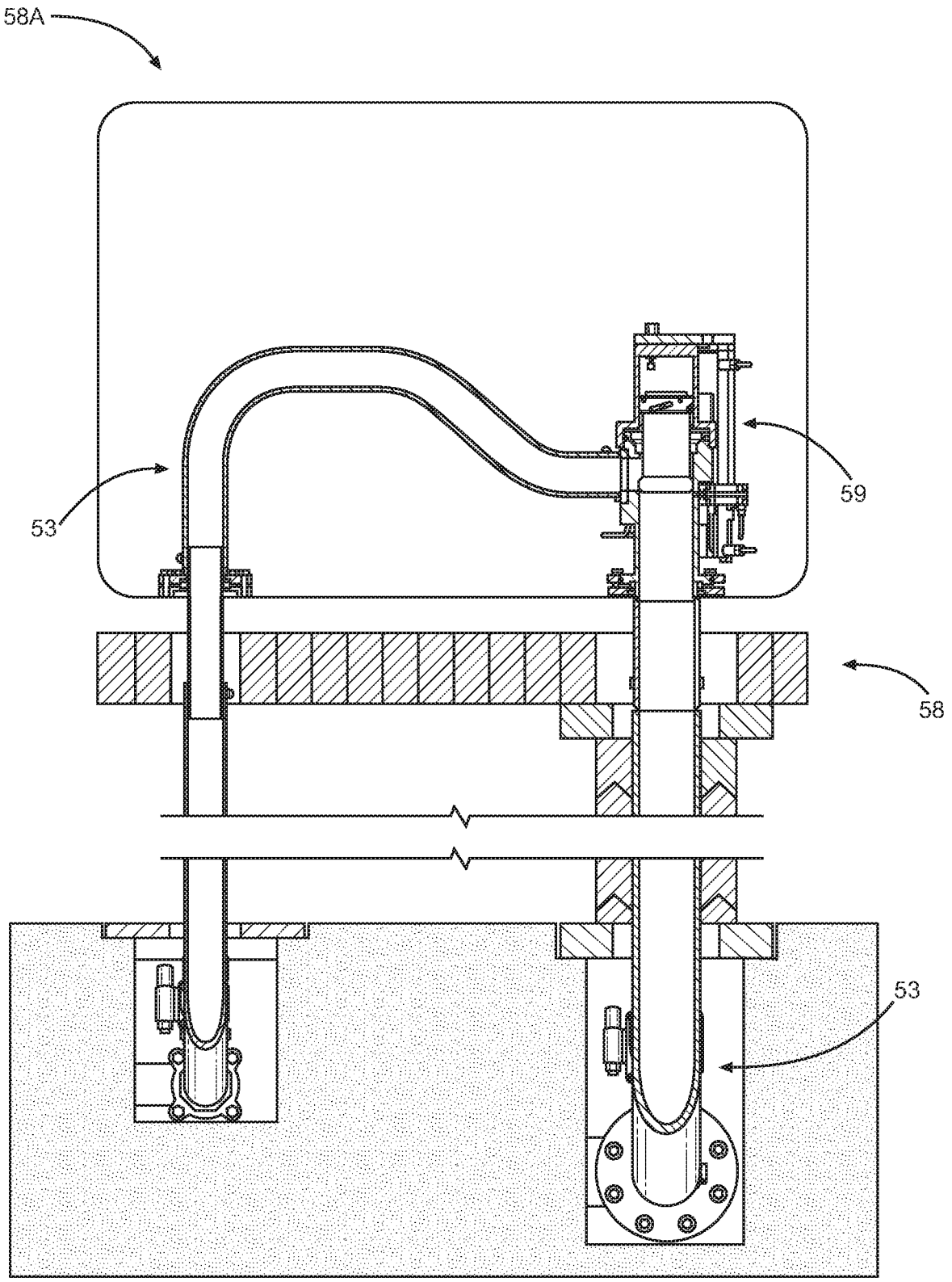
FIG. 21 is an enlarged, fragmentary, isolated schematic illustration of a typical hot cell for receiving the target capsule for processing.

Next, FIG. 21 is a cross-sectional, side view of a radiochemical processing hot cell 58, illustrating the trenched entry and exit points for the target capsule transfer tubing 53, and the radiochemical processing hot cell internal structure 58A includes a target capsule opening/closing device 59 adapted to the limitations of master/slave remote manipulators.

Figure 21A:
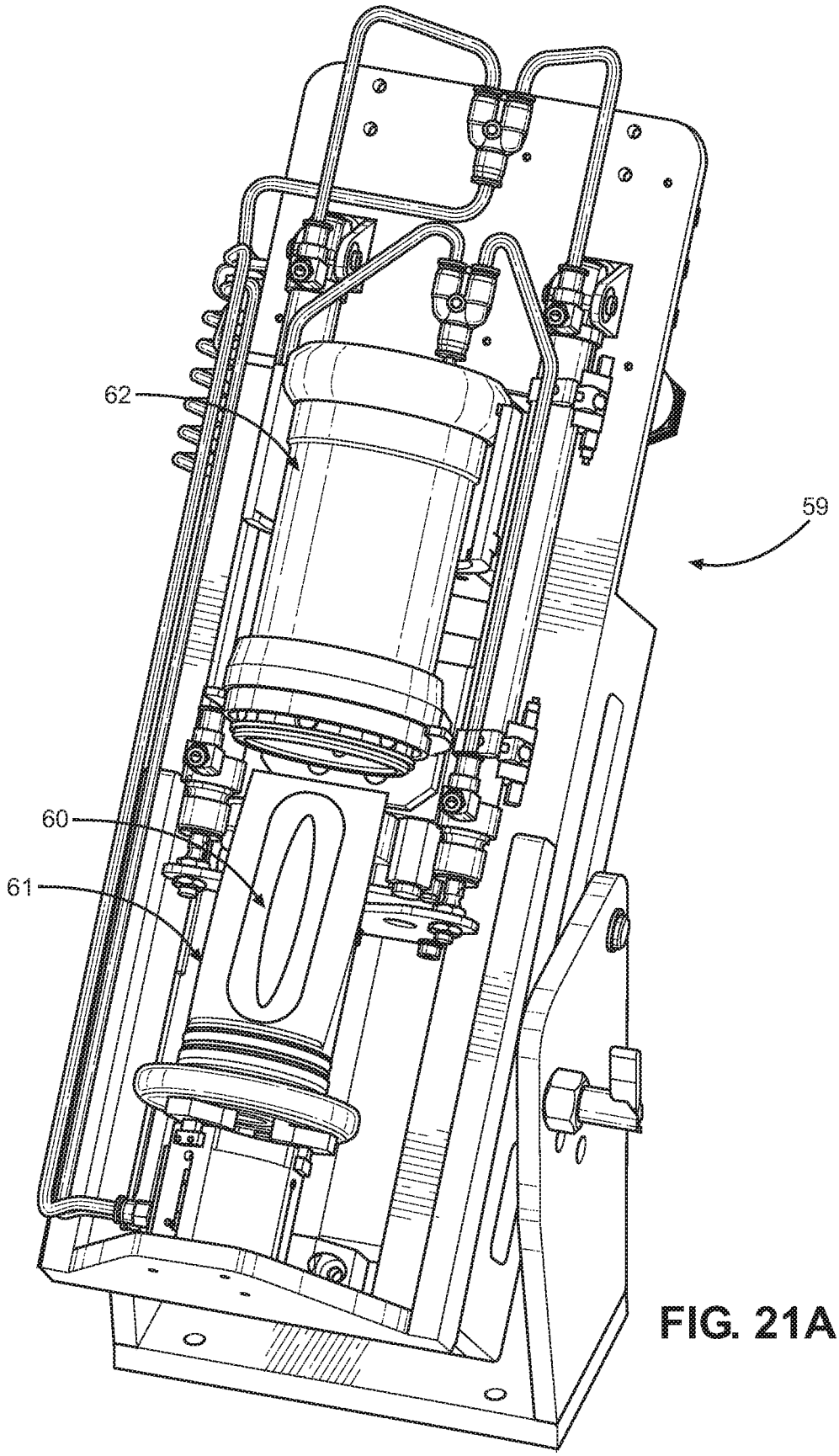
FIG. 21A is an enlarged, fragmentary, isolated schematic illustration of the target capsule remote handling assembly portion of the system of the invention. It allows for opening and closing the target capsule using master/slave remote manipulators within a hot cell for radioisotope processing.

Finally, FIG. 21A is an enlarged, three-dimensional, top perspective view of the target capsule remote manipulator opening/closing device 59. Shown in the open position is a target capsule assembly, with high-power metallic target plate 60, high-power metallic target capsule male portion 61, and high-power metallic target capsule female portion 62. Numeric values and ranges are provided for various aspects of the implementations described above. These values and ranges are to be treated as examples only and are not intended to limit the scope of the claims.

While the invention has been described in conjunction with specific exemplary implementations, it is evident to those skilled in the art that many alternatives, modifications, and variations will be apparent in light of the foregoing description. Accordingly, the invention is intended to embrace all such alternatives, modifications, and variations that fall within the scope and spirit of the appended claims.

What is claimed is:

1. A continuous wave ion linear accelerator PET radioisotope system, configured in straight-linear fashion from a low-energy end to a high-energy end, the system comprising:

a high brightness DC volume-cusp $H^-$ ion source that produces a multi-milliampere beam of $H^-$ ions of about 25 keV;

a continuous wave radio frequency quadrupole (RFQ) linac having a beam ellipse output, wherein the RFQ linac focuses and accelerates the 25 keV $H^-$ ion beam into a multi-milliampere Gaussian profile $H^-$ ion beam of about 1 MeV;

a low-energy beam transport which focuses the 25 keV $H^-$ ion beam for about 95% acceptance by the continuous wave RFQ linac;

a series of one or more continuous wave radio frequency interdigital (RFI) linac tanks having beam ellipse inputs, wherein the RFI linacs accelerate the multi-milliampere Gaussian profile $H^-$ ion beam to about 14 MeV;

a radio frequency coupler medium-energy beam transport that matches the output beam ellipse of the RFQ linac to the input beam ellipse of one of the continuous wave RFI linacs;

one or more high energy beam transports, comprising:

a beam pipe which transports the 14 MeV Gaussian profile $H^-$ ion beam to a laser-photodetachment beam splitter that manipulates the 14 MeV Gaussian profile $H^-$ ion beam such that a substantial portion of the 14 MeV Gaussian profile $H^-$ ion beam forms a Gaussian profile electrically neutral hydrogen beam;

a dipole magnet which provides about a 10° transverse directional force to a remaining portion of the 14 MeV Gaussian profile $H^-$ ion beam;

a hybrid boron-carbon foil in a foil holder which further manipulates a portion of the neutral hydrogen beam by removal of an electron to form a Gaussian profile proton beam;

a water-cooled beam dump which accepts a remaining portion of the neutral hydrogen beam;

a dipole magnet which provides about a 5° transverse directional force to the Gaussian profile proton beam;

a non-linear focusing magnet lattice which further manipulates the Gaussian profile proton beam to form a uniform transverse (Waterbag) profile proton beam; and a high power collimator that shapes the Waterbag proton beam to an about 35 mm diameter Waterbag proton beam;

one or more high power target stations supplying cooling to a target plate, the target plate including a substrate, the target plate located within a target capsule comprised of male and female halves, the 35 mm diameter Waterbag proton beam being incident on the substrate to irradiate the substrate to produce PET radioisotopes; and a target capsule transfer system arranged for loading and unloading of the target capsule, the system comprising:

target transfer tubing forming transfer pathways between the one or more high power target stations and one or more radiochemical processing hot cells;

a blower/suction assembly which provides directional motive forces to the target capsule;

one or more divertor assemblies that configure the target capsule tubing among the one or more target stations and the one or more radiochemical processing hot cells; and a remote handling device configured to lock and unlock the target capsule male and female halves for insertion and removal of the target plate, with locking after insertion of the target plate for loading the target capsule into the target station, and unlocking and removal of the target plate for recovery of the produced PET radioisotopes after irradiation by the incident proton beam.

2. The system of claim 1, further comprising a multiple drive loop configuration of about five solid state radio frequency amplifier power blocks that provide respective accelerating voltages to the radiofrequency quadrupole linac and radiofrequency interdigital linacs.

3. The system of claim 2, wherein the radio frequency amplifier power blocks comprise radio frequency amplifier modules which deliver 100% rated power output with 10% failed amplifier modules.

4. The system of claim 1, wherein the laser-photodetachment beam splitter comprises an optical box.

5. The system of claim 4, wherein the optical box directs a laser beam across the 14 MeV Gaussian $H^-$ ion beam multiple times, such that the electrically neutral hydrogen beam maintains nearly identical parameters as the 14 MeV Gaussian $H^-$ ion beam, including size, divergence, energy, energy spread, and phase spread.

6. The system of claim 5, wherein the non-linear focusing magnet lattice comprises an x-direction octupole magnet, the Gaussian profile proton beam having a y-direction proton beam waist, the x-direction octupole magnet being placed at the y-direction proton beam waist and configured to spread the Gaussian proton beam in an x-direction.

7. The system of claim 6, wherein the Gaussian profile proton beam has vertical and horizontal motion and the non-linear focusing magnet lattice further comprises two focusing quadrupole magnets to decouple the vertical and horizontal motion of the Gaussian profile proton beam.

8. The system of claim 7, wherein the non-linear focusing magnet lattice further comprises a second octupole magnet, the Gaussian profile proton beam having a x-direction proton beam waist, the second octupole magnet being at the x-direction proton beam waist point and configured to spread the Gaussian profile proton beam in a y-direction.

9. The system of claim 8, wherein the Gaussian profile proton beam has a tail and the non-linear focusing magnet lattice further comprises a dodecapole magnet for transverse uniformization of the Gaussian profile proton beam to about 5% rms by removal of the tail of the Gaussian beam folded inside the octupole field when the octupole magnet is excited.

10. The system of claim 1, further comprising an accelerator control computer, and wherein the target plate is an elongated ellipse and the high power collimator is an eight sector water cooled collimator.

11. The system of claim 1, wherein the target plate includes a back side opposite the substrate, and the high power target station coolant comprises a eutectic Ga—Sn alloy flowing on the back side of the target plate in the turbulent flow regime.

12. The system of claim 11, wherein the 35 mm diameter Waterbag proton beam has an axis, and the target plate has an elongated, elliptical shape with cooling fins on the back side to increase its surface area in contact with the eutectic Ga—Sn coolant, and is inclined at about a 10° angle from the 35 mm diameter Waterbag proton beam axis, for high power acceptance of about 1 $kw/cm^2$.

13. The system of claim 1, wherein the target capsule female half includes coolant channels axially symmetric about the beam axis so that no axial positioning system is required.

14. The system of claim 13, wherein the female half further includes indium-wire seals for semi-permanent assembly.

15. The system of claim 1, wherein the one or more high power target stations are in a windowless configuration.

16. The system of claim 15, wherein the target plate is copper and the target substrate is yttrium 89 ($^{89}Y$).

17. The system of claim 15, wherein the target plate is iridium and the target substrate is tellurium 124 enriched oxide ($^{124}TeO_2$).

18. The system of claim 15, wherein the target plate is iridium and the target substrate is enriched copper selenide ($Cu_2{}^{76}Se$).

19. The system of claim 15, wherein the target plate is silver, and the target substrate is enriched nickel 64 ($^{64}Ni$).

* * * * *